US009434582B2

(12) United States Patent
Arthur et al.

(10) Patent No.: US 9,434,582 B2
(45) Date of Patent: Sep. 6, 2016

(54) DUAL CRANE APPARATUS AND METHOD OF USE

(71) Applicants: Brady Paul Arthur, Ralls, TX (US); David Lloyd Arthur, Ralls, TX (US)

(72) Inventors: Brady Paul Arthur, Ralls, TX (US); David Lloyd Arthur, Ralls, TX (US)

( * ) Notice: Subject to any disclaimer, the term of this patent is extended or adjusted under 35 U.S.C. 154(b) by 236 days.

(21) Appl. No.: 14/097,814

(22) Filed: Dec. 5, 2013

(65) Prior Publication Data

US 2014/0150232 A1 Jun. 5, 2014

Related U.S. Application Data

(60) Provisional application No. 61/733,477, filed on Dec. 5, 2012.

(51) Int. Cl.
*B66C 23/00* (2006.01)
*B66C 23/18* (2006.01)

(52) U.S. Cl.
CPC ..... *B66C 23/18* (2013.01); *B66C 23/00* (2013.01); *Y10T 29/4973* (2015.01)

(58) Field of Classification Search
CPC ..... B66C 23/44; B66C 23/48; B66C 13/063; B66C 13/18; B66C 23/00; B66C 23/18; B66C 13/188; Y10S 212/901
See application file for complete search history.

(56) References Cited

U.S. PATENT DOCUMENTS 1,207,423 A * 12/1916 Lundin ..... B63B 27/10 212/233
2,509,950 A * 5/1950 Zierke ..... B60P 1/5433 212/202
2,615,584 A * 10/1952 Adams ..... B66C 23/48 212/180
2,642,007 A * 6/1953 Fox ..... B61C 9/50 105/108
2,679,938 A * 6/1954 Willows ..... B66C 1/105 212/224
2,867,333 A * 1/1959 De Shano ..... B66C 13/18 212/177
2,998,149 A * 8/1961 Bopp ..... B60P 1/5433 212/228
3,059,785 A * 10/1962 Buckeye ..... B66C 23/48 212/261
3,140,857 A * 7/1964 Nickles ..... B66C 19/00 212/233
3,154,199 A * 10/1964 Balogh ..... B66C 13/18 212/231
3,275,296 A * 9/1966 Meyer ..... B66C 23/48 212/261
3,333,712 A * 8/1967 Owen ..... B66C 23/32 212/176
3,433,459 A * 3/1969 Logan ..... B66C 1/10 212/262
3,527,362 A * 9/1970 Allen ..... B66C 23/44 212/238

(Continued)

*Primary Examiner* — Emmanuel M Marcelo
*Assistant Examiner* — Michael Gallion
(74) *Attorney, Agent, or Firm* — Sarah Hegi Simpson; McWhorter, Cobb & Johnson, LLP

(57) ABSTRACT

A dual crane apparatus and a method of use are disclosed herein. The disclosed dual crane apparatus generally comprises a support frame and two rotating crane members mounted to the support frame, wherein the crane members can each independently move up and down in a vertical direction, extend and retract in a horizontal direction, and rotate clockwise and counterclockwise. The disclosed dual crane apparatus can be utilized for servicing mobile irrigation systems.

31 Claims, 11 Drawing Sheets

(56) References Cited

U.S. PATENT DOCUMENTS 3,559,817 A * 2/1971 Brown ..... B66C 13/18 212/231
3,700,117 A * 10/1972 Corley ..... B66C 23/20 212/297
3,774,217 A * 11/1973 Bonner ..... B66C 13/40 182/148
3,910,379 A * 10/1975 Miller ..... B66C 23/163 182/128
3,963,132 A * 6/1976 Dufour ..... B62D 33/0633 180/89.13
3,982,732 A * 9/1976 Pender ..... B66C 23/18 212/195
4,069,922 A * 1/1978 Hawkins ..... B66C 23/78 212/181
4,111,316 A * 9/1978 Wappler ..... B66C 23/44 212/180
4,196,815 A * 4/1980 Gremert ..... B66C 23/84 212/233
4,197,953 A * 4/1980 Frick ..... B66C 23/525 212/233
4,201,305 A * 5/1980 Frick ..... B66C 23/84 212/233
4,202,453 A * 5/1980 Wilkes, Jr. ..... E21F 13/006 180/235
4,214,665 A * 7/1980 Newman ..... B66C 23/64 105/72.2
4,226,331 A * 10/1980 Dumond ..... B66C 23/44 212/258
4,262,812 A * 4/1981 Bremenkamp ..... B66C 5/025 144/285
4,263,797 A * 4/1981 Cooper ..... B21K 1/72 104/307
4,317,524 A * 3/1982 Andersson ..... B63B 27/10 212/261
4,360,112 A * 11/1982 Brewer ..... B66C 17/06 105/163.1
4,508,233 A * 4/1985 Helms ..... B66C 23/48 212/199
4,662,527 A * 5/1987 Cuhel ..... B66C 23/80 212/180
4,700,851 A * 10/1987 Reeve ..... B66C 23/36 212/175
4,727,995 A * 3/1988 Louw ..... B66C 23/44 212/180
4,809,798 A * 3/1989 Moist ..... B62D 51/04 172/256
5,016,544 A * 5/1991 Woollam ..... B60F 1/043 105/215.2
5,064,334 A * 11/1991 Cooley ..... B66C 1/24 212/238
5,076,448 A * 12/1991 Ballard ..... B66C 23/48 212/261
5,100,278 A * 3/1992 Westlake ..... B66C 23/50 104/5
5,103,740 A * 4/1992 Masse ..... B60F 1/043 105/72.2
5,211,526 A * 5/1993 Robinette ..... B60P 1/5471 212/238
5,491,549 A * 2/1996 Wichner ..... B66C 13/063 212/275
5,871,247 A * 2/1999 Greenwell ..... B66C 9/08 294/119.2
5,993,137 A * 11/1999 Harr ..... B60P 1/5433 212/238
6,068,438 A * 5/2000 Barry ..... B66C 1/101 414/344
6,386,820 B1 * 5/2002 Cunningham ..... B60P 1/5428 414/462
6,439,407 B1 * 8/2002 Jacoff ..... B66C 13/08 212/272
6,478,528 B1 * 11/2002 Asbury ..... B60P 1/548 212/180
6,481,749 B2 * 11/2002 Ahlers ..... E02F 9/2025 212/304
6,675,719 B1 * 1/2004 Feider ..... B61K 5/00 104/32.1
6,691,881 B1 * 2/2004 Masse ..... B66C 23/50 212/180
6,826,452 B1 * 11/2004 Holland ..... B66C 1/663 318/566
6,932,326 B1 * 8/2005 Krabbendam ..... B63B 27/10 114/258
7,367,464 B1 * 5/2008 Agostini ..... B66C 13/063 212/308
8,061,277 B2 * 11/2011 Jacob ..... B60F 1/005 105/215.2
8,195,368 B1 * 6/2012 Leban ..... B66C 13/063 212/277
8,235,231 B2 * 8/2012 Schneider ..... B63B 27/10 212/277
8,690,514 B2 * 4/2014 Marola ..... B60P 3/125 212/232
8,939,434 B2 * 1/2015 Selby ..... B66F 19/005 254/2 B
9,096,294 B1 * 8/2015 Dong ..... B63B 27/32
9,108,825 B2 * 8/2015 Kjolseth ..... B66C 13/02
2007/0290181 A1 * 12/2007 Bell ..... B60P 1/548 254/323
2008/0053945 A1 * 3/2008 Schneider ..... B66C 15/065 212/276
2008/0264889 A1 * 10/2008 Larsen ..... B66C 19/002 212/316
2008/0302749 A1 * 12/2008 Sawai ..... B66C 23/64 212/233
2009/0182537 A1 * 7/2009 Kang ..... G09B 9/05 703/2
2010/0264187 A1 10/2010 Buskirk
2013/0167410 A1 * 7/2013 Langdon ..... E02F 3/58 37/195
2014/0083967 A1 * 3/2014 Cormidi ..... B66C 23/42 212/347
2014/0144861 A1 * 5/2014 Davis ..... B66C 23/44 212/230
2014/0251935 A1 * 9/2014 Behnke ..... B66C 13/18 212/285
2014/0300112 A1 * 10/2014 Lee ..... E02D 31/002 290/55
2015/0167342 A1 * 6/2015 Montaner Fraguet .. B66C 23/32 52/745.18
2015/0219123 A1 * 8/2015 Nishikawa ..... E02F 9/123 60/393

* cited by examiner

DUAL CRANE APPARATUS AND METHOD OF USE

CROSS-REFERENCE TO RELATED APPLICATIONS

This application is related to and claims priority from earlier filed U.S. Provisional Patent Application No. 61/733,477, filed Dec. 5, 2012, the disclosure of which is incorporated herein by reference.

BACKGROUND OF THE INVENTION

1. Field of the Invention

The present invention generally relates to a dual crane apparatus and method of use. More specifically, the present invention relates to a dual crane apparatus for servicing mobile irrigation systems.

2. Description of Related Art

Mobile, self-propelled irrigation systems, such as center-pivot or lateral move irrigation systems, are commonly used to irrigate large fields of row crops. These mobile irrigation systems are generally comprised of a plurality of irrigation pipes joined together to form an elongated tubular member supported at various points along its length by wheeled drive towers, which support and propel the irrigation pipe over fields. The irrigation pipe includes sprinklers positioned along its length to irrigate crops below the sprinklers.

As with any other wheeled system, every so often a wheel or tire on one of the towers requires repair or replacement. In which case, a farmer or repairman must jack up the tower in the middle of a wet and muddy field, remove the tire which is often caked in mud, transport the heavy tire out of the field, carry a replacement tire into the field, and replace the tire on the mobile irritation system.

Such a task is practically impossible without the help of multiple people. The tires are extremely heavy and are often stuck in mud, making it even more difficult to remove the tires. The jack used to jack up a mobile irrigation system is usually placed on top of wooden boards in an attempt to form a more even and solid surface for the jack to rest upon. Such boards, however, quickly become muddy and slippery and create a surface on which the jack easily slides off. This process is so dangerous that those skilled in the art commonly refer to such jacks as "widow makers." Obviously, changing a tire on a mobile irrigation system is a labor intensive, strenuous and dangerous undertaking.

Similarly, a need often arises to repair or replace a gearbox on one of the towers of mobile irrigation systems, which requires a similar process to that described above for repairing or replacing a wheel or tire on a mobile irrigation system. To repair or replace a gearbox, a farmer or repairman must jack up the tower, remove the wheel, remove the gearbox, transport the gearbox out of the field, carry a replacement gearbox into the field, replace the gearbox on the mobile irrigation system, and reattach the tire to the mobile irrigation system. Like changing a tire, changing a gearbox on a mobile irrigation system is a labor intensive, strenuous and dangerous undertaking.

As one can see, current methods used to repair or replace tires and gearboxes on mobile irrigation systems are difficult, unsafe, and time-consuming. It is impractical to attempt to manually carry a tire or even a gearbox to and from a tower in the field. This is especially true if the tower requiring repair is located near the center of the field. Plus, the task is made even more challenging when you consider that the soil has been irrigated and the farmer or repairman is forced to trudge through a soft and muddy field to reach the portion of the mobile irrigation system in need of service.

Currently, a need exists for an easy and safe method of servicing mobile irrigation systems. A device and method for servicing mobile irrigation systems is needed that easily allows one person to repair or replace a tire or gearbox on such a system without requiring help from others. Unlike existing methods that require the use of jacks or "widow makers," a need exists for a device that uses safer methods for servicing mobile irrigation systems.

In view of the foregoing, it is apparent that a need exists in the art for a dual crane apparatus for servicing mobile irrigation systems which overcomes, mitigates or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above described drawbacks associated with current devices and methods used to service mobile irrigation systems. To achieve these and other advantages and in accordance with the purpose of the invention, as embodied and broadly described, the present disclosure describes a dual crane apparatus for servicing mobile irrigation systems.

The disclosed dual crane apparatus generally comprises a support frame and two rotating crane members mounted to the support frame, wherein the crane members can each independently move up and down in a vertical direction, extend and retract in a horizontal direction, and rotate clockwise and counterclockwise.

The disclosed apparatus is believed to solve, in a new and unique fashion, many problems related to servicing mobile irrigation systems. The disclosed dual crane apparatus is an all-in-one system that drastically reduces the time, labor, and danger element associated with changing a tire, gearbox or the like on a mobile irrigation system.

The disclosed apparatus is free-standing and is designed to be transported into a field by a tractor or other mobile carrying unit. Once in the field, the dual crane apparatus is designed such that the entire tire changing process can be quickly and easily completed by one user. By using a handheld control to operate the cranes, the disclosed apparatus and method makes an unpleasant, backbreaking job simple and fun.

A further advantage is that the disclosed apparatus and method increase the speed and efficiency of changing a tire or otherwise servicing a mobile irrigation system so that the user can quickly have the irrigation system running again. The disclosed apparatus is designed to hold and transport tools and equipment needed for repairing and servicing a mobile irrigation system, such as toolboxes, an impact wrench, etc. Additionally, the disclosed apparatus includes an area for carrying spare tires, gearboxes or the like, in order to transport such items to and from the mobile irrigation system requiring service, even when such a system is stopped in the middle of a field.

Another advantage of the disclosed apparatus is that by utilizing a dual crane apparatus, the disclosed apparatus does not require the use of dangerous jacks for servicing mobile irrigation systems and thereby greatly reduces the risk of injury of the user.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and form a part of the specification, illustrate embodiments of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF ILLUSTRATIVE EMBODIMENTS

The terms "top," "bottom," "front," and "rear" are used in the specification to describe the embodiments of the invention as illustrated in the accompanying Figures. It should be appreciated that in actual use, an embodiment of the invention may be rotated as needed to accomplish the objectives of the invention. As a result of such rotation, the various terms used herein of "top," "bottom," "front," "rear," and the like may not literally apply to a particular arrangement. Such terms are relative and are used herein to describe the Figures for illustration purposes only and are not intended to limit the embodiments shown to any particular orientation.

Referring now to FIGS. 1-11, exemplary embodiments of a dual crane apparatus 20 and methods of use in accordance with the present disclosure are illustrated.

Figure 1:
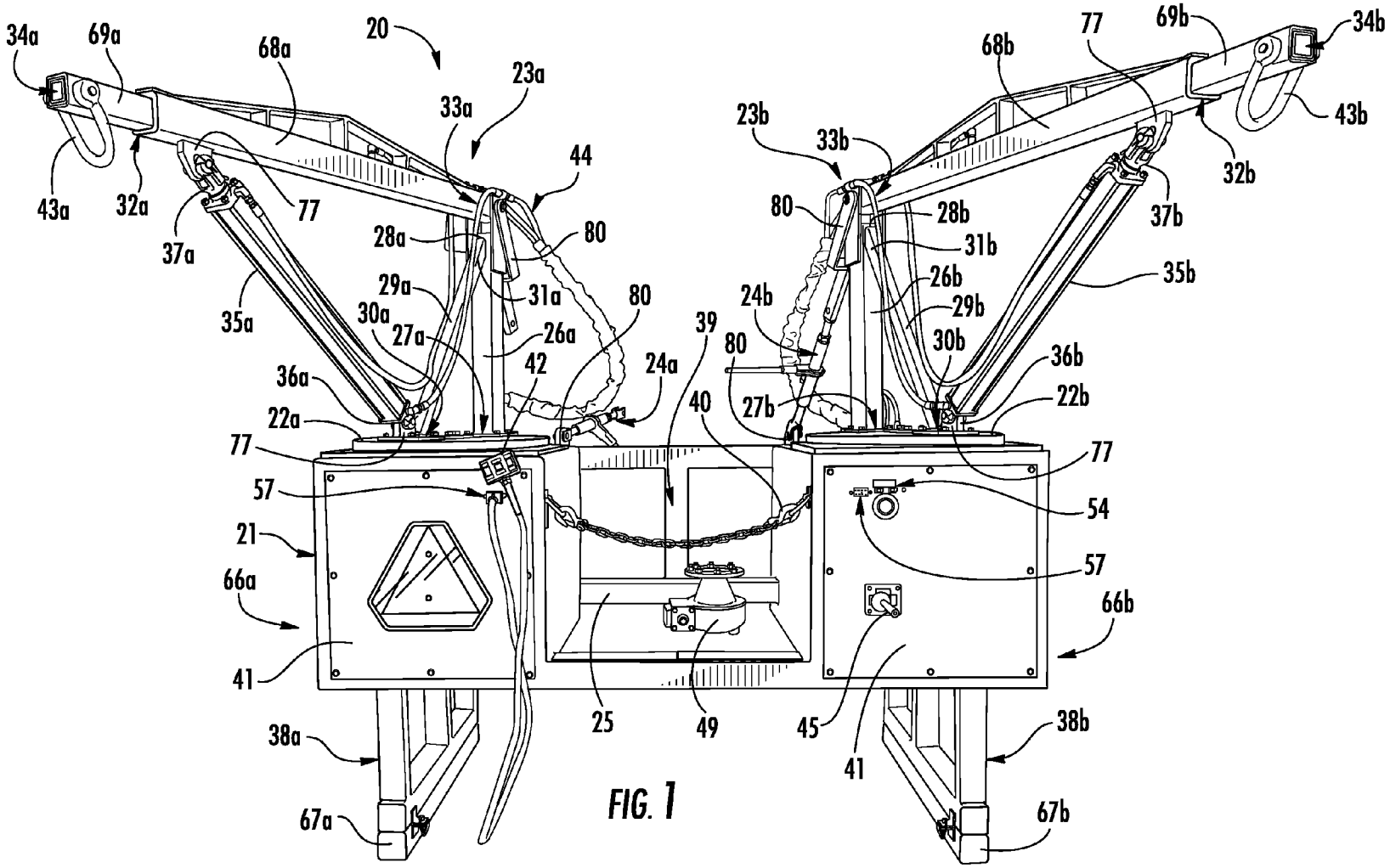
FIG. 1 is a front perspective view of a dual crane apparatus constructed in accordance with the teachings of the present disclosure.

Turning to the Figures for illustrative purpose, FIG. 1 is a front view of a dual crane apparatus 20 according to the present disclosure. The apparatus 20 depicted in FIG. 1 generally includes a support frame 21; a first rotating crane member 23*a* mounted to said support frame 21; and a second rotating crane member 23*b* mounted to said support frame 21.

As shown in the accompanying Figures, the support frame 21 may be substantially rectangular in shape and include a first mounting structure 66*a* for attachment and support of the first crane member 23*a* and a second mounting structure 66*b* for attachment and support of the second crane member 23*b*. The mounting structures 66*a* and 66*b* may be covered by side panels 41, as shown in FIGS. 1-4, to conceal the internal structure of the dual crane apparatus 20. The side panels 41 may be attached to the support frame 21 using any attachment means known to those skilled in the art. For example, the side panels 41 may be bolted, welded, or hinged to the support frame 21. Preferably, at least the end side panels 41 (shown in FIG. 4) are attached to the support frame 21 in a manner that allows the side panels 41 to be easily removed and reattached in order to service the internal structure of the dual crane apparatus 20 if needed.

Figure 4:
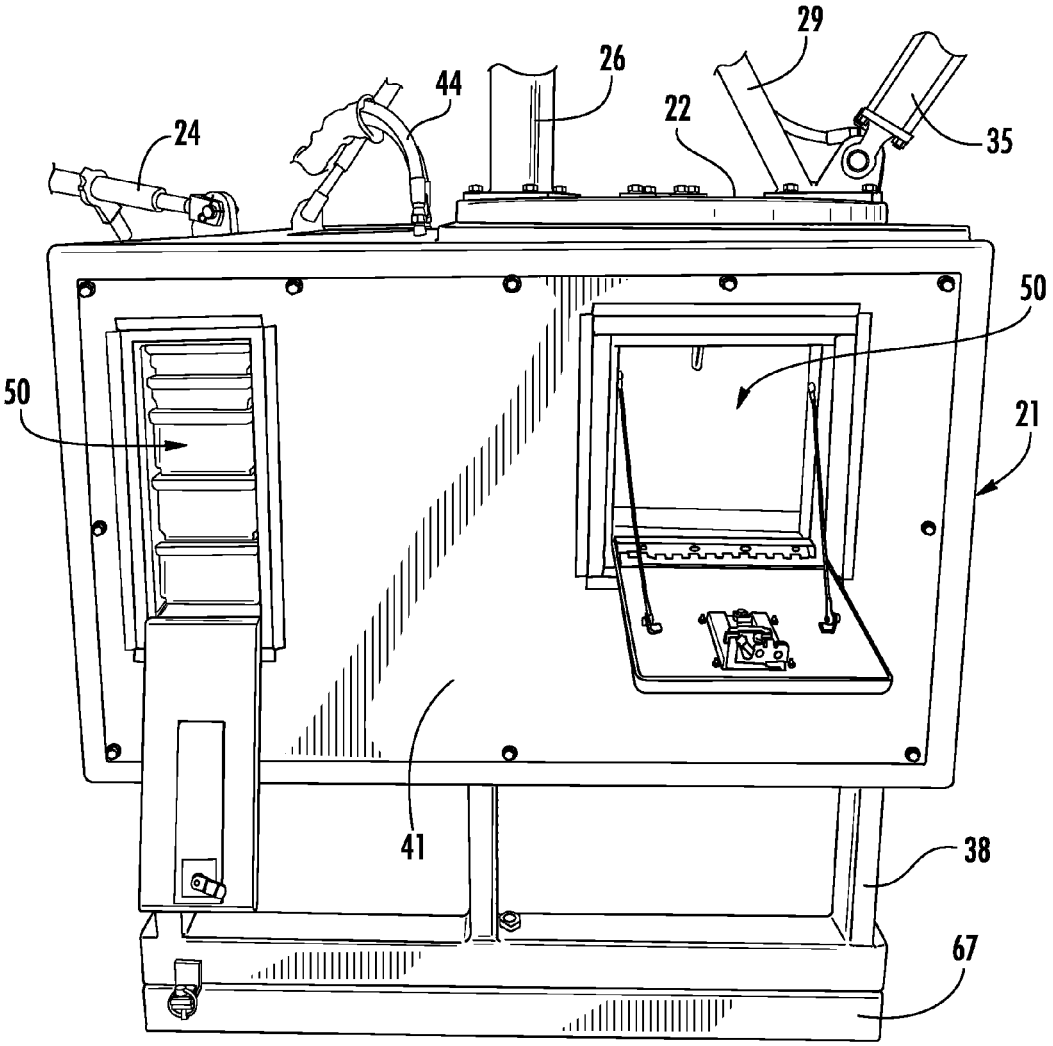
FIG. 4 is a first side perspective view of the dual crane apparatus shown in FIG. 1.
Figure 5:
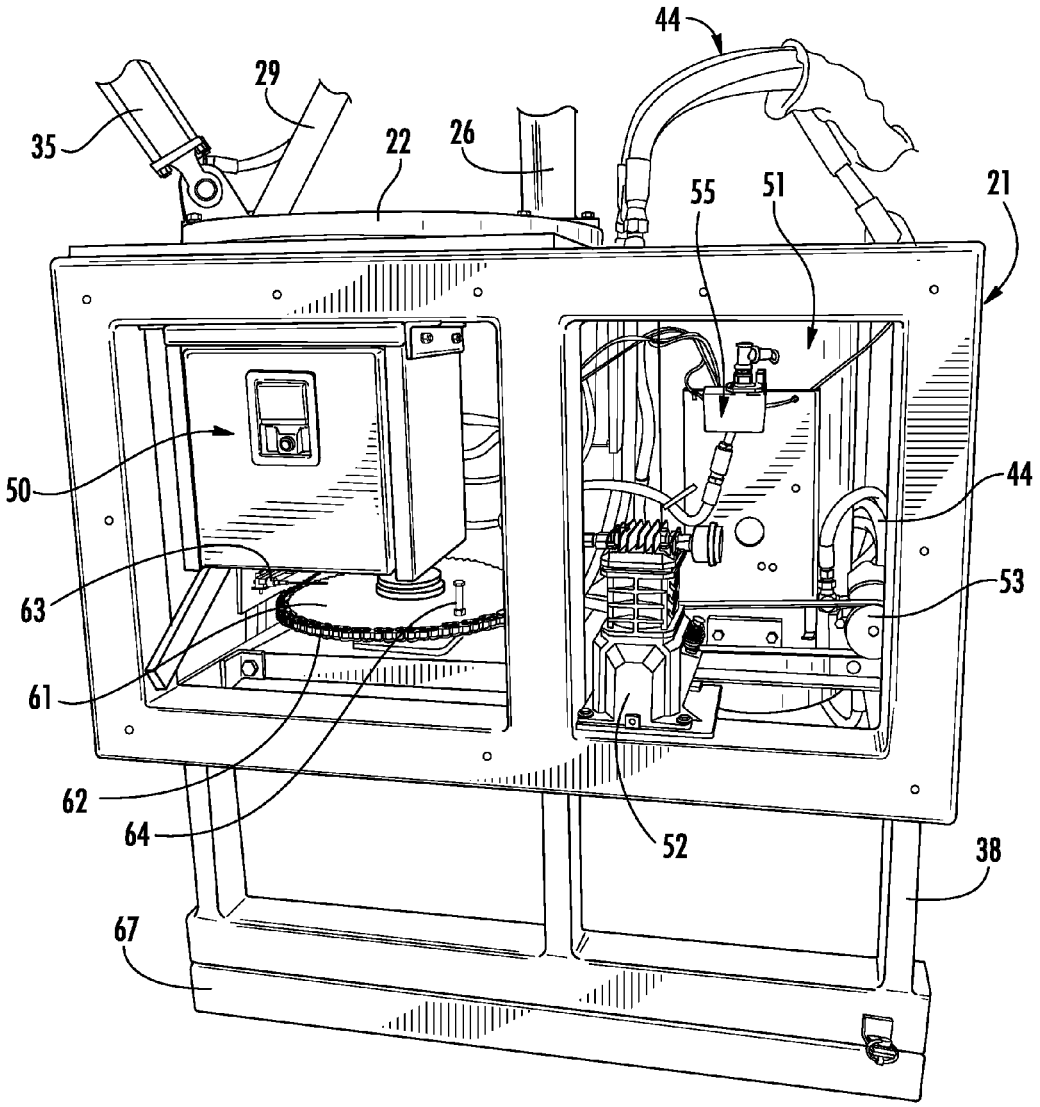
FIG. 5 is a second side perspective view of the dual crane apparatus shown in FIG. 1, showing the internal structure of the dual crane apparatus.
Figure 6:
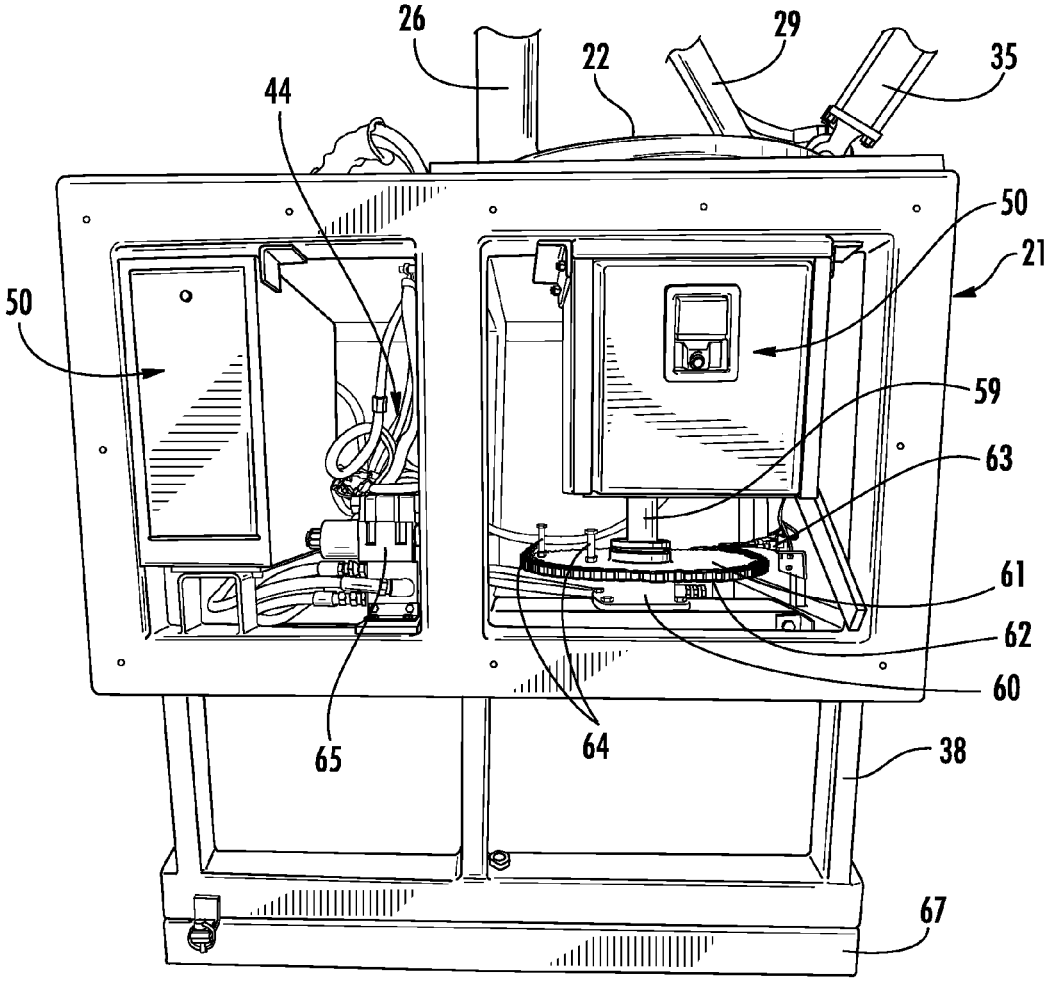
FIG. 6 is a first side perspective view of the apparatus shown in FIG. 1, showing the internal structure of the dual crane apparatus.

As illustrated in FIGS. 4-6, the support frame 21 may further include toolboxes 50, drawers 50, or the like mounted thereto for holding tools and equipment. By configuring the disclosed apparatus 20 to hold and transport tools and equipment, the disclosed apparatus 20 makes it easier for the operator to perform various tasks related to repairing and servicing mobile irrigation systems 62 or other systems in need of repair. The support frame 21 further includes a base which forms the bottom surface of the support frame 21. The base is supported above the ground by legs 38*a* and 38*b*. As will be obvious to those skilled in the art, the legs 38*a* and 38*b* may be configured in a variety of manners, so long as the legs 38*a* and 38*b* are sturdy enough to support the dual crane apparatus 20 above the ground surface in order to avoid crushing and trampling crops that may be located beneath the dual crane apparatus 20.

In one embodiment of the disclosed apparatus 20, the legs 38*a* and 38*b* include feet members 67*a* and 67*b* that are attached to the bottom part of the legs 38*a* and 38*b*. The feet members 67*a* and 67*b* may be attached to the legs 38*a* and 38*b* in a manner in which the feet members 67*a* and 67*b* may be partially unfastened from the legs 38*a* and 38*b* to allow the feet members 67*a* and 67*b* to swivel approximately ninety degrees. In such an embodiment, the central part of the feet members 67*a* and 67*b* remains attached (e.g., bolted) to the legs 38*a* and 38*b* while the end parts of the feet members 67*a* and 67*b* may be detached (e.g., unbolted) from the legs 38*a* and 38*b* to allow the feet members 67*a* and 67*b* to swivel. The feet members 67*a* and 67*b* may be positioned transverse or perpendicular to the legs 38*a* and 38*b* to assist in the stability of the apparatus 20 when it sits on unlevel ground, as is often the case when the apparatus 20 is used in fields of row crops. Please note, the feet members 67*a* and 67*b* may be repositioned only when the apparatus 20 is lifted off the ground surface (e.g., when the apparatus 20 is attached to a mobile carrying unit which lifts the apparatus 20 off the ground). The feet members 67*a* and 67*b* may not be repositioned when the apparatus 20 is resting on the feet members 67*a* and 67*b* after being placed on the ground.

In another embodiment contemplated by the present disclosure, the apparatus 20 includes telescoping legs which allow the base of the support frame 21 to be positioned at different heights above the ground surface. While shorter legs 38*a* and 38*b* may be preferred when the dual crane apparatus 20 is used to repair mobile irrigation systems 62 that water crops such as cotton, sorghum and the like, longer legs may be preferred when the dual crane apparatus 20 is used to repair mobile irrigation systems 62 that water taller crops such as corn.

As shown in the accompanying drawings, the support frame 21 may include a carrying area 39 between the first mounting structure 66*a* and the second mounting structure 66*b*. The carrying area 39 is configured to transport tires 46, gearboxes 49, and other parts or tools to and from mobile irrigation systems 62 in need of servicing. As shown in the attached Figures, the carrying area 39 includes three solid side surfaces, a solid bottom surface, an open front side surface, and an open top surface in order to easily place tires 46, gearboxes 49, and any other equipment in the carrying area 39. The carrying area 39 may further include a restraining member 40, such as a chain, rope, gate or other restraining member, to restrain items from falling out the front side when the dual crane apparatus 20 is being moved by a mobile carrying unit.

Figure 7:
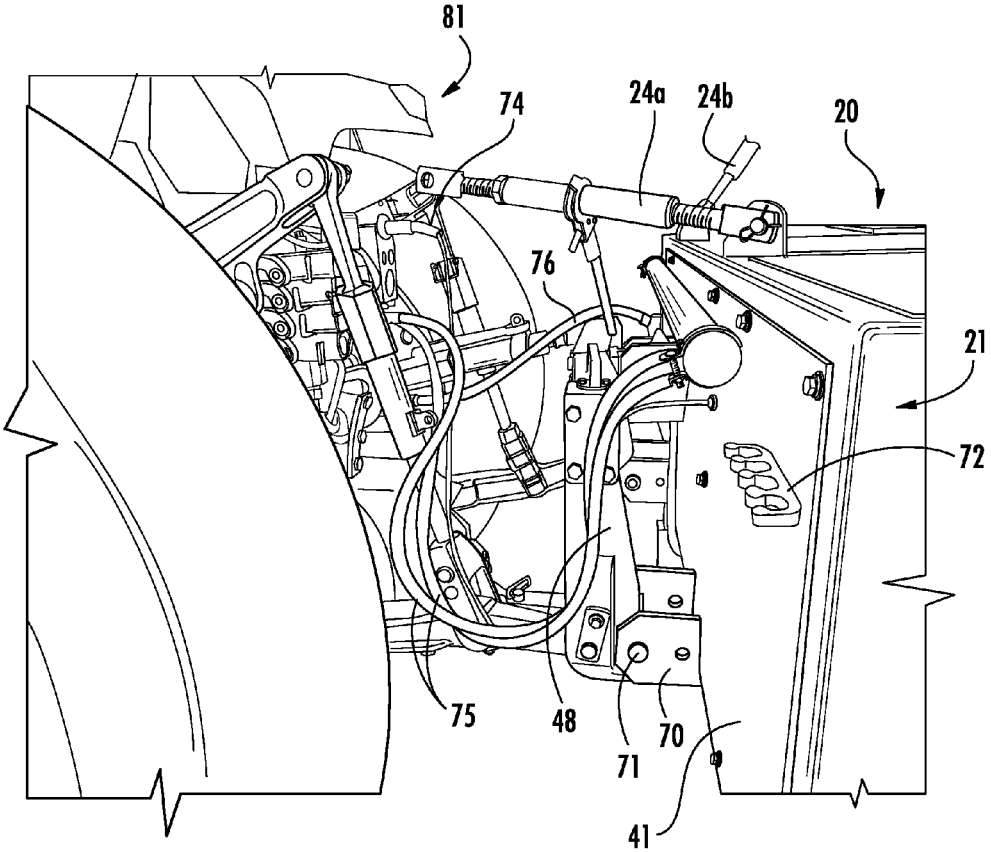
FIG. 7 is a rear perspective view of the dual crane apparatus shown in FIG. 1, showing the dual crane apparatus attached to a tractor.

The disclosed apparatus 20 is configured to be removably affixed to a mobile carrying unit, such as a tractor 81. Turning to FIG. 7, the apparatus 20 is shown attached to a three-point hitch 48 of a tractor 81. As is well known to those skilled in the art, the utility and simplicity of the three-point tractor hitch 48 has made it an industry standard. As a result, in one embodiment contemplated by the present disclosure, the disclosed apparatus 20 is configured to attach to a three-point hitch 48 of a tractor 81.

Three-point hitches 48 include three movable arms. The two lower movable arms have lifting and lowering capabilities and are controlled by the hydraulic system of the tractor 81. The upper center arm is called the top link. Each arm has attachment holes for attaching implements to the hitch 48.

In the present case, the support frame 21 of the disclosed apparatus 20 may include a rear side panel 41 that includes attachment members 70 for attaching the apparatus 20 to a three-point hitch 48. In FIG. 7, the disclosed apparatus 20 is releasably affixed to the tractor 81 by fastening the tractor's three-point hitch 48 to the three attachment members 70 mounted to the rear side panel 41 of the disclosed apparatus 20 (e.g., by inserting pins 71 through the holes formed through each attachment member 70 and the corresponding holes formed through each hitch arm). The disclosed apparatus 20 also can be easily detached from the tractor 81 by unfastening the three-point hitch 48 of the tractor 81 from the attachment members 70 of the apparatus 20.

The mobile carrying unit used to transport the disclosed apparatus 20 is not limited to a tractor 81. One skilled in the art can appreciate that there are numerous embodiments that exist for the mobile carrying unit used to transport the disclosed apparatus 20 to and from mobile irrigation systems 62, all of which are considered to be within the spirit and scope of the present invention. For example, the disclosed apparatus 20 may be configured for attachment to a forklift in order to increase the maximum height of the apparatus 20, which would be especially useful in fields of tall crops such as corn. Also, any self-propelled machine, such as a combine harvester with the header removed, a cotton harvester, or a sprayer could be used as the mobile carrying unit for the disclosed apparatus 20. Alternatively, the disclosed apparatus 20 could be configured to attach to a mobile trailer and be powered by a self-contained power source (e.g., an auxiliary power unit), in which case a conventional pickup truck could be utilized as the mobile carrying unit. As will be obvious to those skilled in the art, numerous embodiments of mobile carrying units may be used to transport the disclosed apparatus 20 from one job to the next.

As shown in FIGS. 1, 2, and 8-10, the disclosed dual crane apparatus 20 may further include a first rotating plate 22*a* and a second rotating plate 22*b* mounted to the mounting structures 66*a* and 66*b* of the support frame 21. In this embodiment, the top surface of each rotating plate 22 is configured for attachment of a crane member 23. By attaching the crane members 23*a* and 23*b* to the rotating plates 22*a* and 22*b*, the crane members 23*a* and 23*b* are able to rotate clockwise and counterclockwise, as need and desired by the operator.

Figure 8:
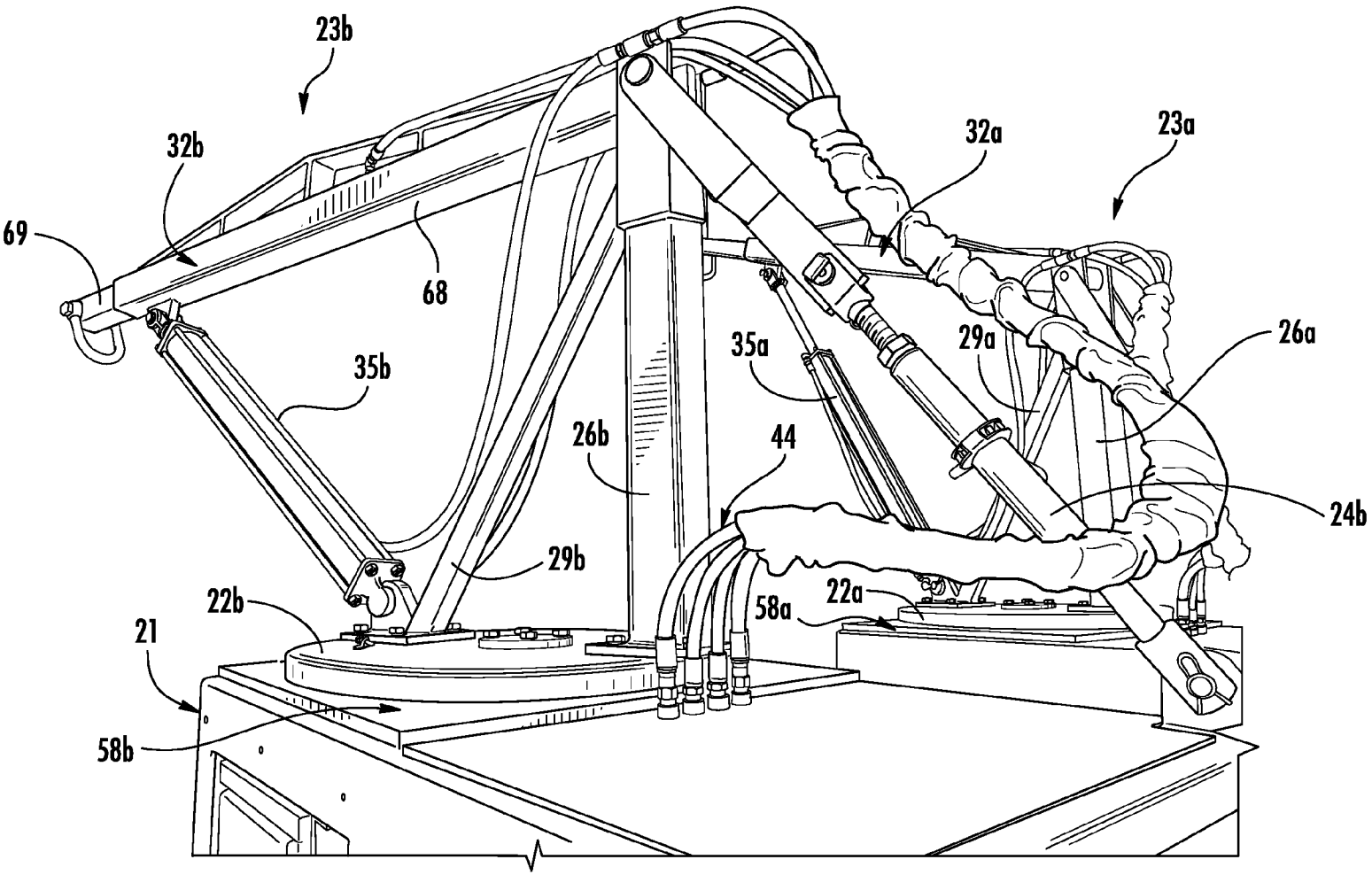
FIG. 8 is an rear perspective view of the dual crane apparatus shown in FIG. 1.

As can be seen in FIG. 8, each top rotating plate 22 may be connected to a bottom fixed plate 58. The fixed plates 58*a* and 58*b* are each attached to the top of the mounting structures 66*a* and 66*b* and do not rotate or otherwise move. The rotating plates 22*a* and 22*b* and fixed plates 58*a* and 58*b* may define turret plates or large conventional thrust bearings, so that the weight of a load lifted by a crane member 23 is transferred to the top rotating plate 22, which then transfers the load through ball bearings to the bottom fixed plate 58.

As can be partially seen in FIG. 6, the disclosed apparatus 20 may further include a rotating shaft 59, which is attached to a top rotating plate 22 and travels downward through a hole in the bottom fixed plate 58 and connects to a lower bearing 60 acting to constrain the shaft 59 from radial movement. A sprocket 61 or the like may be attached along the length of the rotating shaft 59. The sprocket 61 is turned by a drive chain 62 that is connected to and first turned by a second sprocket that is directly attached to a drive motor (not shown), such as an orbit motor. The motor may be attached to and supported by the support frame 21 of the apparatus 20.

As will be appreciated by those skilled in the art, many other methods and systems may be utilized to provide rotation to the rotating plates 22*a* and 22*b* and attached crane members 23*a* and 23*b*. In most embodiments, at least two bearing supports (e.g., a lower bearing support 60 and an upper bearing support) will be used for each crane member 23 to support the weight of the loads lifted by the crane members 23*a* and 23*b*. Additionally, some form of a rotational force applied to the rotating plates 22*a* and 22*b* is required to force rotation of the rotating plates 22*a* and 22*b* and the attached crane members 23*a* and 23*b*. As explained above, a drive motor that turns a sprocket 61 that forces rotation of the rotating shaft 59 attached to the rotating plate 22 may be used. Other means, such as a gear drive, belt drive or direct drive, could be used to provide rotation to the rotating shaft 59 and rotating plate 22. As will be obvious to those skilled in the art, alternative means are available to transmit the rotational force to the rotating shaft 59 and rotating plate 22, all of which are considered to be within the spirit and scope of the present invention.

In the embodiment shown in FIGS. 1, 2, and 8-10, the disclosed dual crane apparatus 20 further includes a first crane member 23*a* mounted to the first rotating plate 22*a* and a second crane member 23*b* mounted to the second rotating plate 22*b*. The first crane member 23*a* and second crane member 23*b* are configured identically, and therefore, unless otherwise noted, description of one crane member 23 applies to the other crane member 23 as well.

In this embodiment shown in FIGS. 1, 2, and 8-10, each crane member 23 includes a vertical arm 26 having a first end 27 and a second end 28. The first end 27 of the vertical arm 26 is attached to a rotating plate 22. The second end 28 of the vertical arm 26 is articulately connected to a first end 33 of a telescoping horizontal arm 32. Each crane member 23 may further include a bracing arm 29 for further supporting the crane member 23. As shown in this embodiment, the bracing arm 29 has a first end 30 attached to the rotating plate 22 and a second end 31 attached to the second end 28 of the vertical arm 26.

Each crane member 23 in this embodiment further includes an actuating arm 35 for moving the second end 34 of the telescoping horizontal arm 32 up and down in a vertical direction. The actuating arm 35 has a first end 36 attached to an attachment member 77 affixed to the rotating plate 22 and a second end 37 attached to an attachment member 77 affixed near the second end 34 of the telescoping horizontal arm 32. As illustrated in the attached Figures, the actuating arm 35 may define a hydraulic cylinder.

In this embodiment, each crane member 23 further includes a telescoping horizontal arm 32 that comprises a fixed member 68 and a telescoping member 69. The fixed member 68 is articulately connected to the second end 28 of the vertical arm 26. As illustrated in the attached Figures, the telescoping member 69 may be partially disposed within the fixed member 68 so that the telescoping member 69 is supported by the internal walls of the fixed member 68 and the telescoping member 69 may only move axially in respect to the fixed member 68. An appropriate lubricant may be added to the internal walls of the fixed member 68 to reduce friction caused by the movement of the telescoping member 69.

The telescoping member 69 has a first end and a second end 34. In the accompanying drawings, the first end of the telescoping member 69 is disposed within the fixed member 68. The first end of the telescoping member 69 is attached to an actuating member (not shown) that is disposed inside the fixed member 68 (please note, alternative embodiments may include an externally mounted actuating member). The actuating member may define a hydraulic cylinder or any other actuating means that will be obvious to the skilled artisan. In this embodiment, the internal actuating member has a first end and a second end. The first end of the actuating member is attached to the telescoping member 69. The second end of the actuating member is articulately connected to the second end 28 of the vertical arm 26. A fastener, such as a pin, may articulately connect the second end 28 of the vertical arm 26 to the first end 33 of the telescoping horizontal arm 32. The same fastener may also be used to articulately connect the second end of the internal actuating member to the second end 28 of the vertical arm 26.

As illustrated in the attached Figures, the second end 34 of the telescoping horizontal arm 32, which is also the second end 34 of the telescoping member 69, may further include a fastener 43 attached thereto. The fastener 43 may be defined as a clevis fastener or any other appropriate fastener known to those skilled in the art. As shown in FIGS. 2, 3, 9, and 10, a lifting member 47 (e.g., a chain, rope, cable, hook, pulley, or the like) can be attached to the fastener 43 and used for lifting a tire 46, gearbox 49, mobile irrigation system 62, or anything else that requires lifting and/or maneuvering by a crane member 23.

Figure 2:
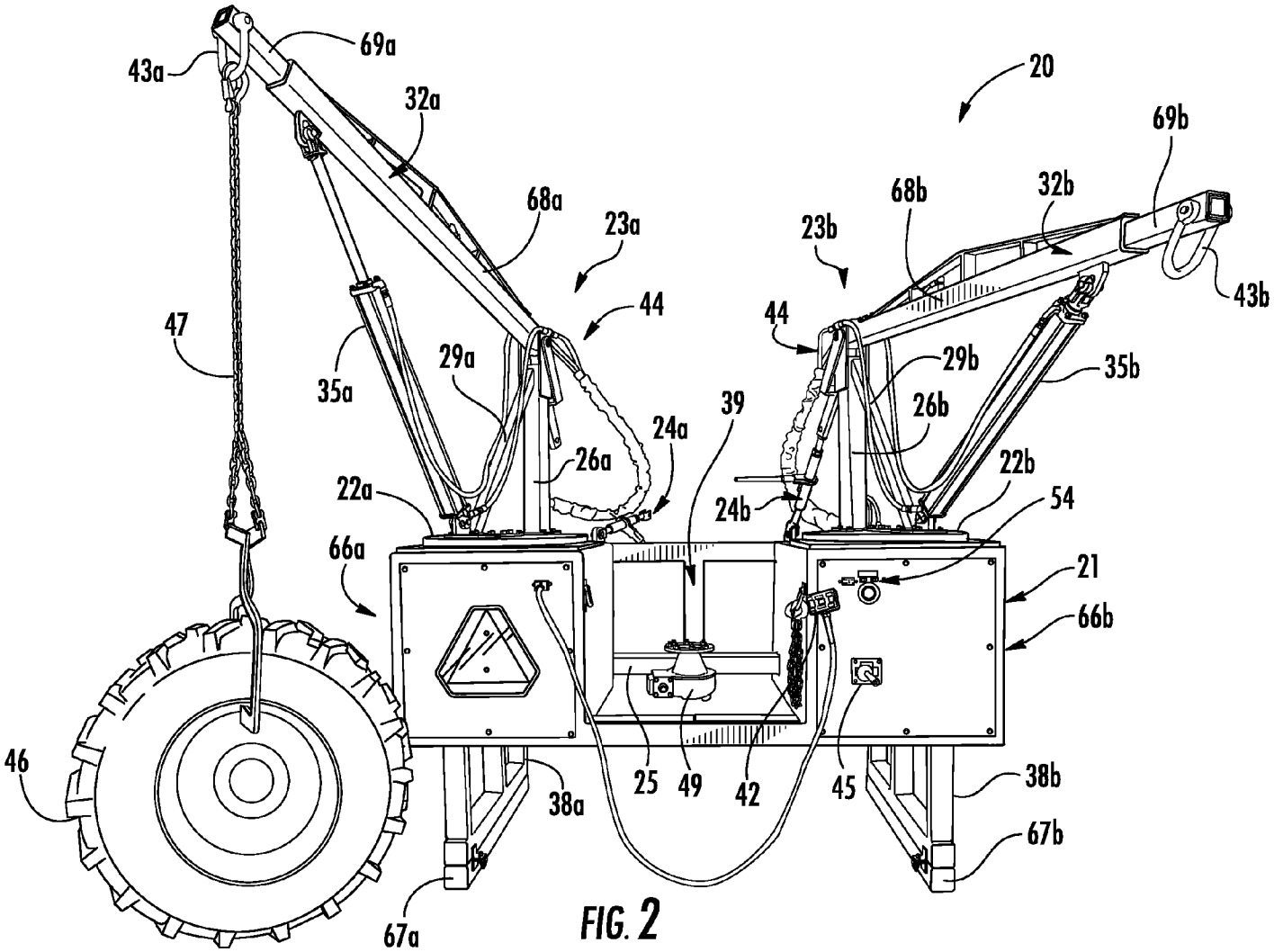
FIG. 2 is a front perspective view of FIG. 1, showing a tire of a mobile irrigation system attached to a crane member.
Figure 3:
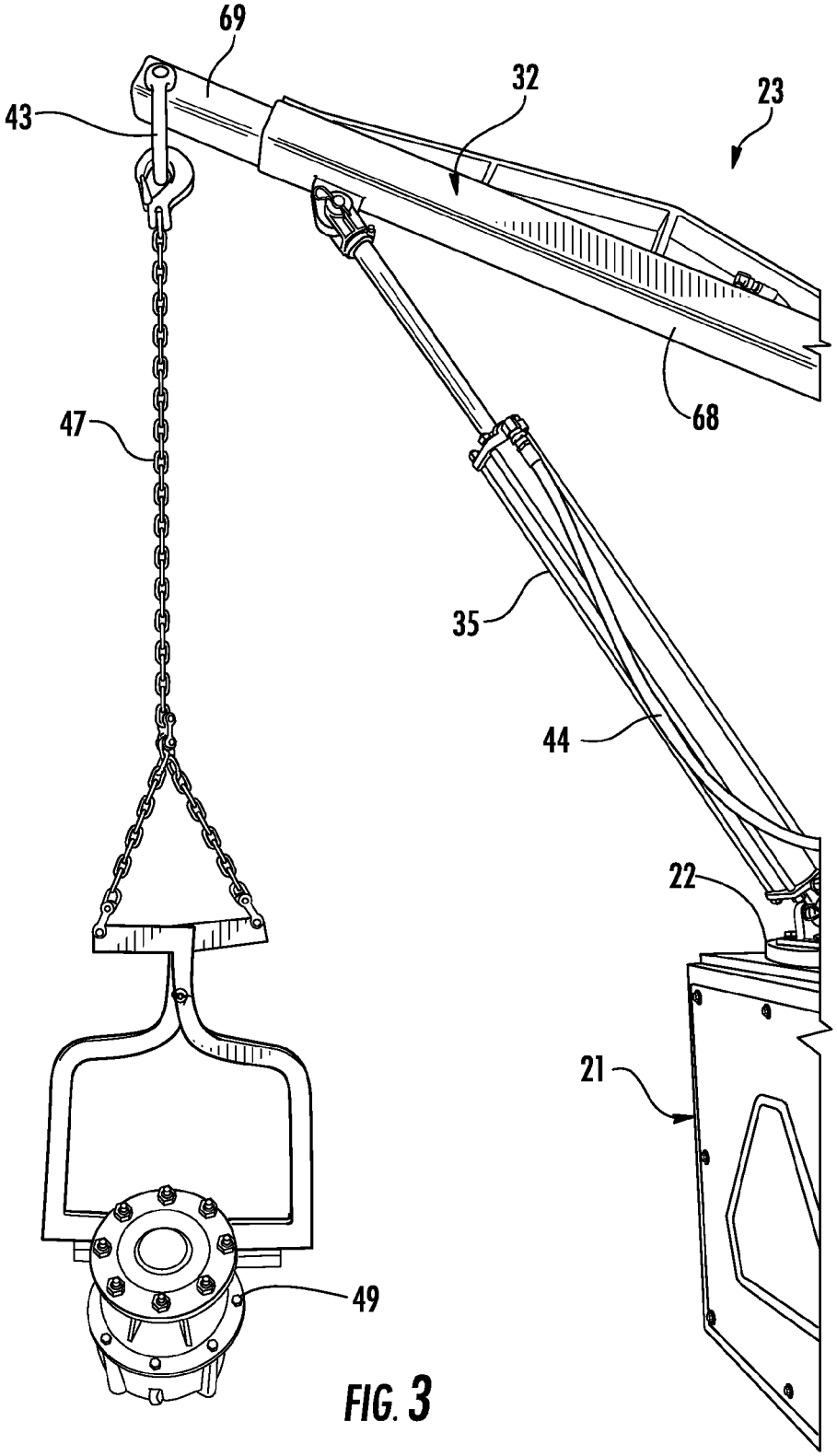
FIG. 3 is a partial view of FIG. 1, showing a gearbox of a mobile irrigation system attached to a crane member.

Each crane member 23 in this embodiment may further include a locking arm 24 for preventing rotation of the crane member 23 when the crane member 23 is being transported or when rotation of the crane member 23 is not needed or desired. As shown in FIGS. 1-2, the locking arm 24*b* of the second crane member 23*b* is in a locked position wherein the locking arm 24*b* is attached to an attachment point 80 affixed to the second mounting structure 66*b* as well as to an attachment point 80 affixed to the second crane member 23*b* (see FIG. 8). In this embodiment, the locking arm 24*a* of the first crane member 23*a* is in an unlocked position wherein the locking arm 24*a* is detached from the attachment point 80 affixed to the first crane member 23*a*.

Figure 9:
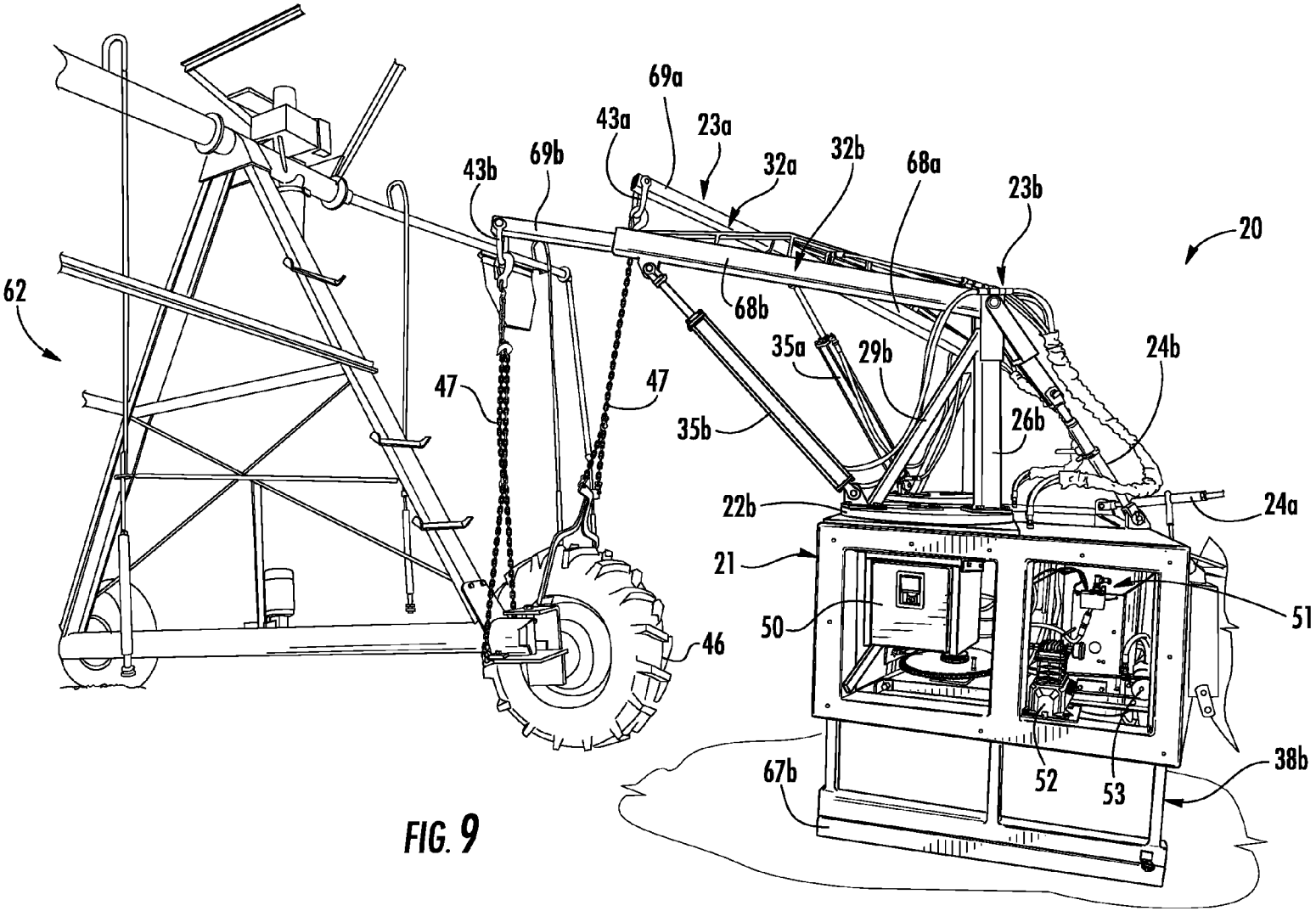
FIG. 9 is a side perspective view of the dual crane apparatus shown in FIG. 1, wherein the apparatus is being used to service a mobile irrigation system.
Figure 10:
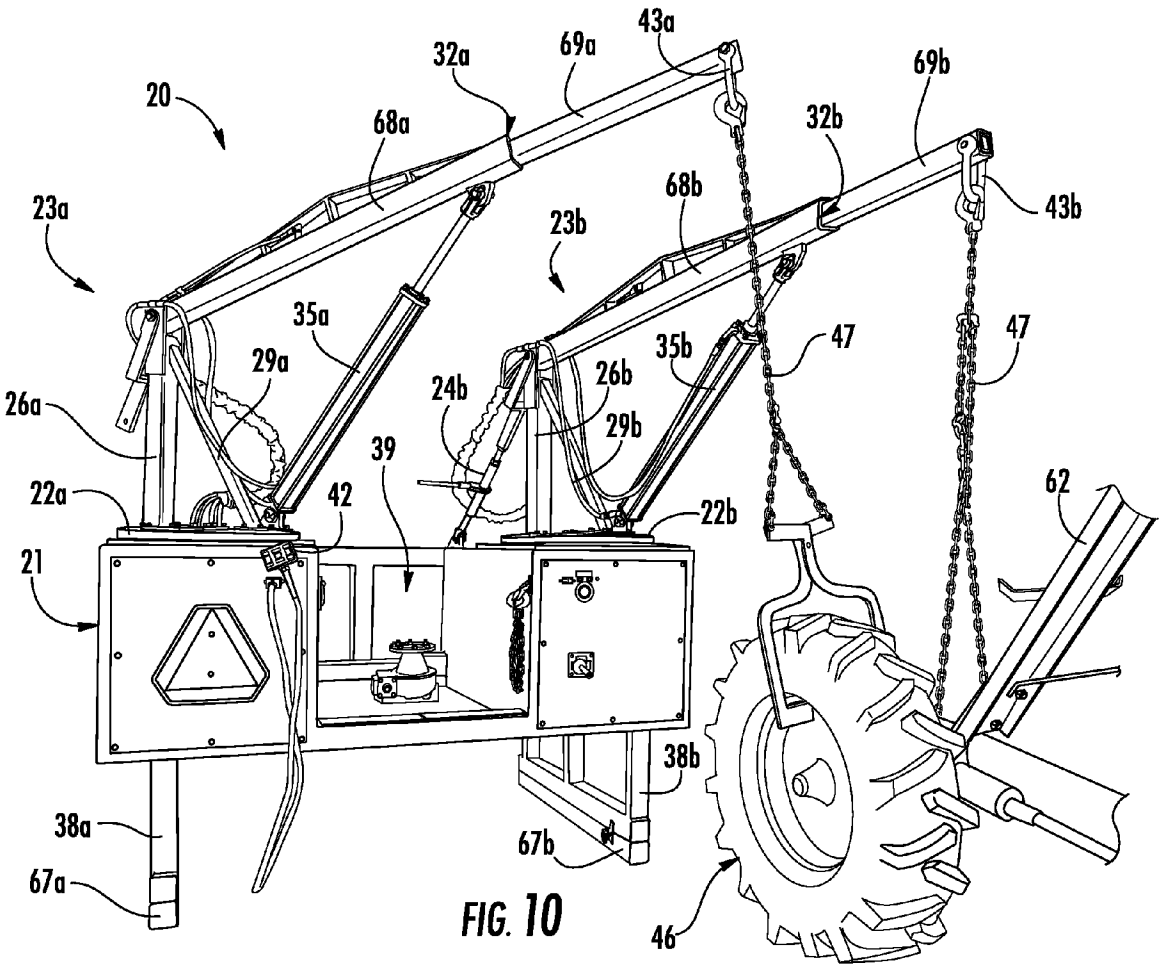
FIG. 10 is a front perspective view of the apparatus shown in FIG. 1, wherein the apparatus is being used to service a mobile irrigation system.

Typically, when changing a tire 46 or a gearbox 49 on a mobile irrigation system 62, one crane member 23 is used only for lifting the mobile irrigation system 62 off the ground (see the second crane member 23*b* in FIGS. 9-10). Since rotation of this crane member 23, which is used only for lifting the mobile irrigation system 62 off the ground, is not needed, the locking arm 24 of this lifting crane member 23 remains in the locked position. While in the locked position the locking arm 24 prevents the crane member 23 from rotating clockwise and counterclockwise, but it does not prevent the crane member 23 from moving up and down in a vertical direction or from extending and retracting in a horizontal direction. The opposite crane member 23 (see the first crane member 23*a* in FIGS. 9-10), which is used for maneuvering the flat tire 46 or damaged gearbox 49 off the mobile irrigation system 62 to the carrying area 39 of the disclosed apparatus 20 and which is used for maneuvering the replacement tire 46 or gearbox 49 onto the mobile irrigation system 62, must be able to rotate in order to properly perform such actions. Therefore, when using the disclosed apparatus 20 for replacing a tire 46 or gearbox 49 on a mobile irrigation system 62, generally, the locking arm 24 of one of the crane members 23 is moved to the unlocked position (see the locking arm 24*a* of the first crane member 23*a* in FIGS. 1-2) and the locking arm 24 of the opposite crane member 23 may be left in the locked position (see the locking arm 24*b* of the second crane member 23*b* in FIGS. 1-2).

The disclosed apparatus 20 may further include an air compressor system for operation of air powered tools or devices. As shown in FIGS. 1 and 5, the air compressor system includes an air tank 51, a pressure control switch 55, an operator control switch 54, a motor 53 (e.g., a hydraulic orbit motor), an air compressor unit 52 and appropriate hoses and fittings for air flow. Please note, while the use of a hydraulic motor is discussed below, it should be appreciated that an electric, gas or other appropriate motor may alternatively be used.

For operation of the air compressor system, the operator control switch 54 must be in the "on" position. The pressure control switch 55 senses the pressure of the air contained in the air tank 51. If the pressure is adequate, the air compressor 52 will not compress additional air. If the pressure in the tank 51 is below the adequate value or the required pressure, the pressure control switch 55 sends a signal to the main valve body 65. The main valve body 65 then directs hydraulic fluid (e.g, oil) to the motor 53 that is coupled to the air compressor unit 52. As shown in FIG. 5, the air compressor 52 may be connected to the driving motor 53 by a belt and sheave system. The belt and sheave system requires little maintenance and allows the belt to slip if needed. For instance, if the air compressor 52 locks up, the belt can slip to prevent the driving motor 53 from locking up and damaging the motor seals. Those skilled in the art will appreciate that the air compressor unit 52 alternatively may be connected to the driving motor 53 by a chain and sprocket drive, a direct drive with appropriate coupling, a gear driven assembly, or any other appropriate connection known to those skilled in the art.

Once the air compressor 52 begins compressing air, the air compressor 52 fills the air tank 51 to the required value or pressure. Once the pressure in the air tank 51 exceeds the required value or pressure, the pressure control switch 55 ceases to send a signal to the main valve body 65, which in turn stops the flow of hydraulic fluid to the driving motor 53. For safety reasons and to provide for control by the operator, the operator control switch 54 is mounted externally on the disclosed apparatus 20, as shown in FIGS. 1-2. The operator control switch 54 is wired in series with the pressure control switch 55, which allows the operator to turn off the air compressor system if desired. Additionally, due to the wiring pathway being in series, the operator is unable to force the air compressor 52 to operate past the required value of air pressure, as the signal would be halted by the pressure control switch 55. In one preferred embodiment, the electric current utilized by the air compressor system is obtained from a tractor 81 and uses the same fuse as the circuit that powers a handheld control 42, as is further discussed below.

Air stored in the air tank 51 is allowed to flow through a hose and piping system to an air hose outlet 45 that allows different air powered tools or devices (e.g., impact wrenches, air wands, pneumatic jacks, hose for airing up flat tires, etc.) to be attached. The disclosed apparatus 20 may further include an automatic retractable air hose reel for conveniently storing the air hose 45. Such a reel can help protect the hose 45 from damage and makes the hose 45 easily accessible for the operator. In one embodiment, the reel may be attached to the support frame 21 and positioned behind the toolbox 50 shown in FIG. 5. Alternatively, the air hose 45 may be simply stored in a toolbox 50 mounted to the support frame 21 of the disclosed apparatus 20.

In one preferred embodiment of the disclosed dual crane apparatus 20, the apparatus 20 includes a hydraulic system for operation of the crane members 23*a* and 23*b* and air compressor system. A hydraulically operated system is especially preferred when the dual crane apparatus 20 is transported by a tractor 81 as the mobile carrying unit, as the hydraulic system of the apparatus 20 is easily connected to the hydraulic system of a tractor 81. Most tractors have an adequate hydraulic fluid supply for operation of the dual crane apparatus 20. It is possible, however, to use a pump mounted to the power take-off of a tractor 81 to provide the hydraulic power required. Alternatively, an auxiliary power unit could be used to drive a hydraulic pump for the hydraulic system of the disclosed apparatus 20.

Turning to FIG. 7, the rear side of a tractor 81 is shown with hydraulic hoses 75 connecting the hydraulic system of the tractor 81 to the hydraulic system of the disclosed apparatus 20. The tractor 81 includes a set of hydraulic ports, which come standard on tractors sold in the United States. The disclosed dual crane apparatus 20 includes hoses 75 with couplings on the free ends of the hoses 75. These couplings fit into the hydraulic ports on the tractor 81. The hoses shown in FIG. 7 include a supply hose 75, a return hose 75, and a drain line 76 from the air compressor motor 53. The hoses may be attached to the tractor 81 by means of quick-couplings that allow an operator to easily and quickly attach and detach the dual crane apparatus 20 to and from a tractor's hydraulic system. When the hoses 75 and 76 are not connected to a tractor 81 or other mobile carrying unit, the hoses 75 and 76 can be conveniently inserted into the hose clip 72 that is attached to the rear side panel 41 of the apparatus 20. The hose clip 72 keeps the hoses 75 and 76 off the ground and helps protect the hoses 75 and 76 from damage.

In the embodiment depicted in FIG. 7, the hoses 75 and 76 enter through the rear side panel 41 of the dual crane apparatus 20. The supply hose 75 connects to an inlet of the main valve body 65 and the return hose 75 connects to an outlet of the main valve body 65. The dedicated drain line 76 connects directly to the drain port of the air compressor motor 53. Please note, the drain line 76 for the air compressor motor 53 may not be included in many embodiments, as not all motors include a drain port and, therefore, an air compressor motor 53 may be selected that does include a drain line 76.

The hydraulic system of the disclosed apparatus 20 may include three hydraulic motors (i.e., a first motor for rotation of the first crane member 23*a*, a second motor for rotation of the second crane member 23*b*, and a third motor 53 for operating the air compressor 52). Additionally, the hydraulic system of the dual crane apparatus 20 may include four hydraulic cylinders (i.e., an actuating arm 35*a* for the first crane member 23*a*, an actuating member that is disposed within the telescoping horizontal arm 32*a* of the first crane member 23*a*, an actuating arm 35*b* for the second crane member 23*b*, and an actuating member that is disposed within the telescoping horizontal arm 32*b* of the second crane member 23*b*) for providing movement to the first crane member 23*a* and the second crane member 23*b*.

Each hydraulic component (i.e., each hydraulic motor and hydraulic cylinder) includes two hydraulic hoses 44, a supply hose and a return hose, which connect each hydraulic component to the main valve body 65. The hoses 44 connecting each hydraulic component to the main valve body 65 carry hydraulic fluid as directed by the main valve body 65. The main valve body 65 may be a manual valve body, which is manually controlled by an operator to direct the flow of hydraulic fluid. In another preferred embodiment, the hydraulic system includes an electrically actuated main valve body 65, which allows it to be controlled by electrical signals from a handheld control 42. In such an embodiment, the main valve body 65 receives a signal, as further described below, to allow or stop the flow of hydraulic fluid. When it receives an appropriate signal, the main valve body 65 allows hydraulic fluid from the supply line to flow to the appropriate hydraulic component via a supply hose. The return hoses carry return hydraulic fluid from the hydraulic components back to the main valve body 65. The main valve body 65 then directs the return hydraulic fluid back to the tractor 81.

In the embodiment shown in the accompanying drawings, the hydraulic system includes one main valve body 65 disposed within either the first mounting structure 66*a* or the second mounting structure 66*b*. The support frame 21 may further include a hollow square tube 25 for protecting and passing hydraulic hoses from one side of the apparatus 20 to the other side of the apparatus 20 that houses the main valve body 65.

In one preferred embodiment anticipated by the present disclosure, the dual crane apparatus 20 includes a handheld control 42 for operating the first crane member 23*a* and the second crane member 23*b*. Once the hydraulic hoses of the disclosed apparatus 20 are connected to the hydraulic system of a tractor 81 and the tractor 81 is supplying hydraulic fluid to the main valve body 65 of the apparatus 20, the electronic switches on the handheld control 42 can be manipulated by the operator to control the crane members 23*a* and 23*b*.

For example, to move a crane member 23 up or down in a vertical direction, an electrical signal is sent from a switch (i.e., the up or down switch) of the handheld control 42 through the wires of the handheld control 42 that communicate with the main valve body 65. This electrical signal causes the main valve body 65 to allow hydraulic fluid to flow in a specific direction to a designated cylinder. For instance, flow of hydraulic fluid into the bottom of the actuating arm 35 (when the actuating arm is defined as a hydraulic cylinder) forces the actuating arm 35 to extend upwards, whereas flow of hydraulic fluid out of the bottom portion of the actuating arm 35 forces the actuating arm 35 to retract downwards. Obviously, if the hydraulic cylinder or actuating arm 35 were turned upside down, the flow directions would be reversed.

A similar process is required to extend or retract the telescoping horizontal arms 32*a* and 32*b* of the crane members 23*a* and 23*b*. An electrical signal is sent from another switch (i.e., the extend or retract switch) on the handheld control 42 through the wires of the handheld control 42 that communicate with the main valve body 65. The electrical signal causes the main valve body 65 to allow hydraulic fluid to flow in a specific direction to the actuating member disposed within the telescoping horizontal arm 32. For instance, flow of hydraulic fluid into the bottom of the actuating member (when the actuating member is defined as a hydraulic cylinder) forces the telescoping member 69 of the horizontal arm 32 to extend outwards from the fixed member 68 of the horizontal arm 32, whereas flow of hydraulic fluid out of the bottom portion of the actuating member forces the telescoping member 69 of the horizontal arm 32 to retract further inside the fixed member 68 of the horizontal arm 32. Once again, if the actuating member were turned upside down, the flow directions would be reversed.

In one embodiment of the disclosed apparatus 20, the handheld control 42 includes at least three separate switches for operating each crane member 23. One switch moves the crane member 23 up or down in a vertical direction. Another switch extends and retracts the telescoping horizontal arm 32 of the crane member 23. A third switch rotates the crane member 23 clockwise or counterclockwise. These manually operated switches are electromechanical devices with electrical contacts, which are connected to external circuits. Each set of contacts can be in one of two states—either "closed" meaning the contacts are touching and electricity can flow between them, or "open" meaning the contacts are separated and electricity cannot flow between them. The mechanism actuating the transition between these two states (i.e., open or closed) can be either a "toggle" (i.e., flip switch for continuous "on" or "off") or "momentary" (i.e., push and hold for "on") type. In a preferred embodiment of the disclosed apparatus 20, the switches are the "momentary" type, meaning the switches must be pushed and held for "on." Therefore, movement of the crane members 23*a* and 23*b* (i.e., movement up or down, rotation clockwise or counterclockwise, or extension or retraction) all require an operator to push and hold the appropriate switch to cause the desired movement. Thus, unless the operator is pushing and holding down one of the control switches on the handheld control 42, the crane members 23*a* and 23*b* will not move. While toggle type switches could be used, momentary type switches are preferred as they greatly increase the safety of the disclosed apparatus 20.

The disclosed apparatus 20 is preferably configured so that the crane members 23*a* and 23*b* can each move in three directions simultaneously. For obvious reasons, the crane members 23*a* and 23*b* cannot move both up and down in a vertical direction at one time. The handheld control 42 and main valve body 65 are configured to prevent such opposing movements (i.e., a single crane member trying to simultaneously move both up and down). On the other hand, the handheld control 42 and main valve body 65 are configured so that there are no restraints against "harmonious" movements (e.g., there are no restraints against moving up, extending out, and rotating clockwise all at the same time). Additionally, two handheld controls 42 can be connected to the apparatus 20 at once to allow both crane members 23*a* and 23*b* to be operated at the same time. The crane members 23*a* and 23*b* are configured so that the actions of the first crane member 23*a* do not affect the actions of the second crane member 23*b* and vice versa. Therefore, the first and second crane members 23*a* and 23*b* can move at the same time and they can move in different directions.

When a tractor 81 is used as the mobile carrying unit, the handheld control 42 draws electrical power from the electrical system of the tractor 81. As shown in FIG. 7, an electrical cord and plug 74 from the dual crane apparatus 20 is connected to an electrical outlet on the tractor 81 that provides direct current power (typically, such tractor outlets provide 12 volt direct current power). Alternatively, as will be obvious to those skilled in the art, electrical power may be drawn from other sources such as a battery bank, a generator, or the like.

In one embodiment of the disclosed apparatus 20, electrical power from a tractor 81 passes through a wire 74 plugged into the electrical outlet of the tractor 81 and passes into the circuitry of the disclosed apparatus 20. The electric current then passes through a fuse on the disclosed apparatus 20, then through the main switch (i.e., a switch mounted on the apparatus 20 that turns off the power to the handheld controls 42 and air compressor system if desired) and, finally, the electric current passes into the handheld control 42. At the handheld control 42, the electric current is distributed by the switches in the handheld control 42 (dependent on the operator's selection) down the corresponding wire to the attached section of the main valve body 65. This electrical signal from the handheld control 42 causes the main valve body 65 to direct flow of hydraulic fluid to the corresponding hydraulic component.

FIGS. 1-2 show two electrical outlets 57 attached to the front side panels 41 of the disclosed apparatus 20. In this embodiment, the plug end of the handheld control 42 may be inserted into the outlet 57 below the crane member 23 that the operator wishes to operate. For example, in FIGS. 1-2, the handheld control 42 must be plugged into the outlet 57 on the left side below the first crane member 23*a* to control the first crane member 23*a*, or the handheld control 42 must be plugged into the outlet 57 on the right side below the second crane member 23*b* to control the second crane member 23*b*.

In the embodiment shown in the attached drawings, a single handheld control 42 can be plugged into either the left outlet 57 for controlling the first crane member 23*a* or the control 42 can be moved and plugged into the right outlet 57 for controlling the second crane member 23*b*. Alternatively, two handheld controls 42 can be used and each control 42 can be plugged into an outlet 57 for operating the first and second crane members 23*a* and 23*b* at the same time. In other embodiments, the apparatus 20 may include only one electrical outlet 57 and a single handheld control 42 that is configured to operate both crane members 23*a* and 23*b*. In yet another embodiment, a wireless handheld control powered by batteries may be used to operate the crane members 23*a* and 23*b*.

In still other alternative embodiments, the need for a handheld control 42 is completely eliminated. Mechanical valve bodies are available that do not require an electrical system for operation. A series of valves, operated by hand, could control every action of the disclosed apparatus 20, including movement of the crane members 23*a* and 23*b*, operation of the air compressor motor 53, and operation of the limit switches 63. Such a hand operated valve system, however, would limit the movement of the operator to a confined space (i.e., a space within reach of the manual valve body) and such a system would make it hard for a single person to operate the disclosed apparatus 20 while also servicing a mobile irrigation system 62, such as changing a tire 46 or replacing a gearbox 49 on a mobile irrigation system 62. When using a handheld control 42, the operator is not forced to remain within reach of the main valve body 65, and freedom of movement allows the operator to better utilize the features of the disclosed apparatus 20 while servicing a mobile irrigation system 62.

As shown in FIGS. 5-6, the disclosed apparatus 20 may further include one or more limit switches 63 to control the degree of rotation of the crane members 23*a* and 23*b*. Generally, a limit switch 63 is an electromechanical device that includes an actuator mechanically linked to a set of contacts. When an object comes into contact with the actuator, the limit switch 63 operates the contacts to make or break an electrical connection.

The limit switches 63 used with the disclosed apparatus 20 are wired in series with the handheld control 42 and correspond with the direction of rotation (i.e., the switch for clockwise rotation on the handheld control 42 is connected to a first limit switch 63, and the switch for counterclockwise rotation on the handheld control 42 is connected to a second limit switch 63). For example, when an operator holds the switch on the handheld control 42 for clockwise rotation of a crane member 23, this causes a signal to travel from the handheld control 42 through the first limit switch 63 to the main valve body 65. The main valve body 65 directs flow of hydraulic fluid in the desired direction (in this case, flow required for clockwise rotation) to the motor attached to the chain drive 62 of the crane member 23. The rotation of the motor causes rotation of the crane member 23. The crane member 23 will continue to rotate clockwise until a tab 64, which is attached to the sprocket 61 that rotates with the crane member 23, trips the limit switch 63. Obviously, the operator also could simply release the switch for clockwise rotation on the handheld control 42 in order to stop rotation. However, for situations in which the operator continues to hold the switch for clockwise rotation past the set range of motion allowed for clockwise rotation, the limit switch 63 will be tripped and the operator cannot override the limit switch 63 by continuing to hold the clockwise rotation switch on the handheld control 42. The limit switch 63, once tripped, halts the signal from the handheld control 42 to the main valve body 65. Once the main valve body 65 is no longer receiving a signal, the main valve body 65 stops the flow of hydraulic fluid to the drive motor, which stops rotation of the crane member 23.

The limit switches 63 automatically reset once the crane member 23 is rotated in the opposite direction. In a preferred embodiment, the first crane member 23*a* and the second crane member 23*b* have separate series circuits so that the actions of one limit switch 63 for one crane member 23 do not affect another limit switch 63 for the other crane member 23. In other words, the first limit switch 63, which limits clockwise rotation, for the first crane member 23*a* will not stop the first crane member 23*a* from rotating counterclockwise. Likewise, the first limit switch 63 for the first crane member 23*a* will not stop the second crane member 23*b* from rotating clockwise or counterclockwise. Each limit switch 63 only limits rotation in one direction for its corresponding crane member 23. In alternative embodiments, a single limit switch 63, which is able to limit both clockwise and counterclockwise rotation, could be used for each crane member 23.

Figure 11:
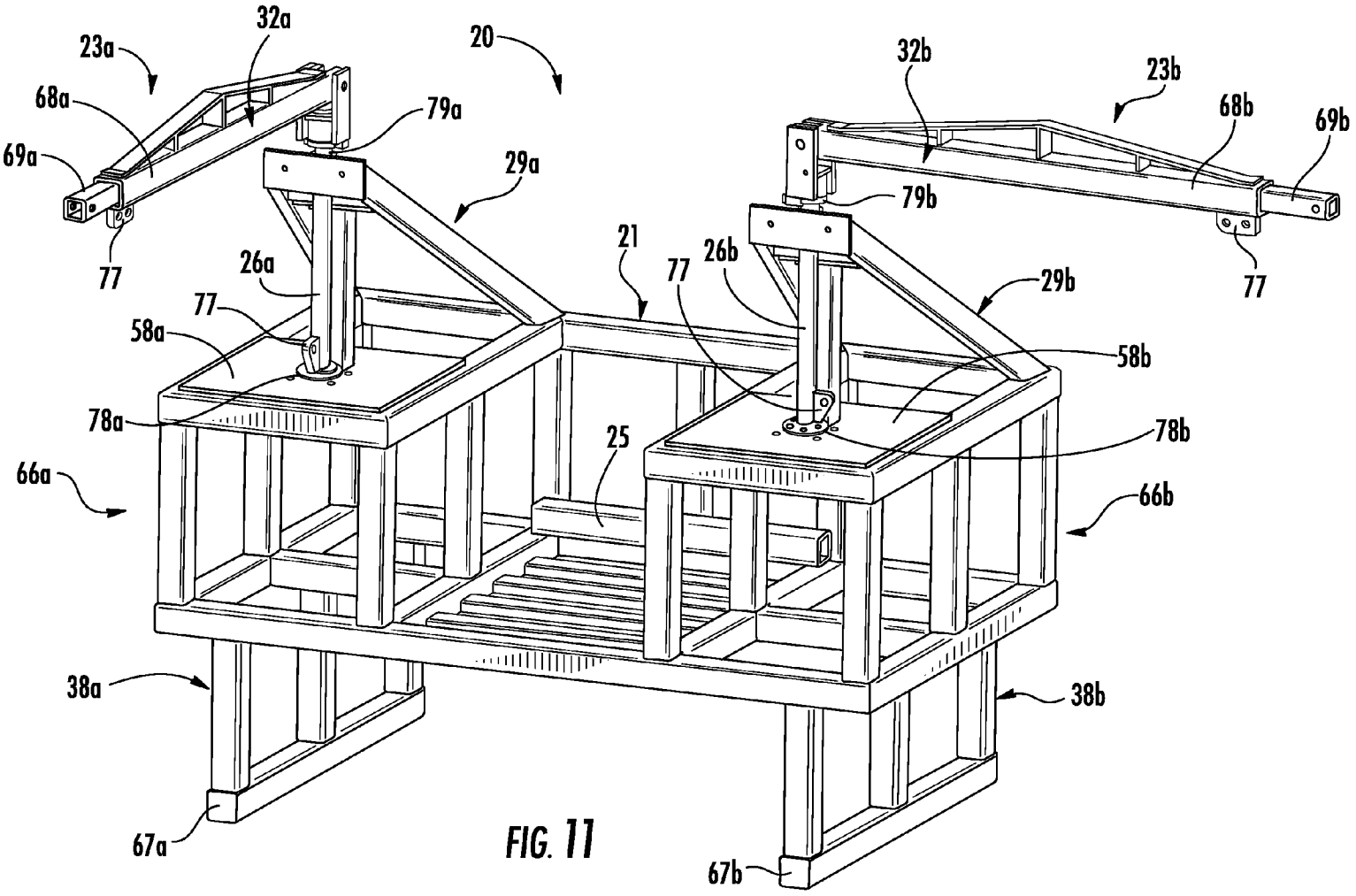
FIG. 11 is a front perspective view of an alternative embodiment of a dual crane apparatus constructed in accordance with the teachings of the present disclosure.

Turning to FIG. 11, an alternative embodiment of the disclosed dual crane apparatus 20 is shown which generally includes a support frame 21, a first rotating crane member 23*a* mounted to the support frame 21, and a second rotating crane member 23*b* mounted to the support frame 21. In this embodiment, rather than mounting each crane member 23 to a rotating plate, the vertical arm 26 of each crane member 23 comprises a rotating shaft. The top end of the rotating vertical arm 26, which is connected to the telescoping horizontal arm 32, includes a first bearing member 79 (e.g., a radial bearing) for further supporting the telescoping horizontal arm 32. The rotating vertical arm 26 passes through a second bearing member 78 (e.g., a large thrust bearing or table bearing), then through a hole in the fixed plate 58, and finally through a third bearing member (not shown), such as a radial bearing, that is mounted below the surface of the fixed plate 58. A gearbox or the like (not shown) is attached at the bottom end of the rotating vertical arm 26 to apply rotational force from an attached motor, which causes the vertical arm 26 and all connected parts to rotate as desired. This embodiment further includes bracing arms 29*a* and 29*b* that are configured to better support the crane members 23*a* and 23*b* and bearing members. Though not shown in FIG. 11, this embodiment further includes actuating arms 35*a* and 35*b* attached to the attachment members 77 affixed to the rotating vertical arms 26*a* and 26*b* and attached to the attachment members 77 affixed to the telescoping horizontal arms 32*a* and 32*b*. This embodiment would further include many of the same features as described above for FIGS. 1-10.

Turning to FIGS. 9 and 10, a novel method for servicing mobile irrigation systems 62 using the disclosed apparatus 20 is shown. Please note, while the following description describes the apparatus 20 as shown in FIGS. 9 and 10, the actions performed by the first crane member 23*a* could also be performed by the second crane member 23*b*, and the actions performed by the second crane member 23*b* could also be performed by the first crane member 23*a*. The terms "first" and "second" used to describe the crane members 23*a* and 23*b* are interchangeable and are used merely for ease of description.

The following description describes a method of using the disclosed apparatus 20 for changing a tire 46 on a mobile irrigation system 62. Those skilled in the art will appreciate that a similar method can be used for otherwise servicing a mobile irrigation system 62 or for servicing many other systems in need of repair. In operation, the dual crane apparatus 20 is first attached to a mobile carrying unit (e.g., a tractor 81) that is able to transport the apparatus 20 into a field. Once in the field, the apparatus 20 is placed on the ground near the defective tire 46 of the mobile irrigation system 62, as shown in FIG. 9. Once the apparatus 20 is set in place, the operator unlocks the locking arm 24*a* of the first crane member 23*a* to allow the first crane member 23*a* to rotate as needed. Please note, the embodiment of the apparatus 20 shown in FIG. 11 does not include locking arms 24*a* and 24*b*. Therefore, this step would not be required when using an embodiment of the apparatus 20 that does not include locking arms 24*a* and 24*b*.

Next, in the embodiment shown in FIGS. 9 and 10, the operator plugs the handheld control 42 into the appropriate outlet 57 for operating the second crane member 23*b*. The handheld control 42 may include a magnet on the backside of the control 42, which allows the operator to attach the control 42 to a side panel 41 of the apparatus 20 to keep the control 42 off the ground and out of the mud, as shown in FIG. 10.

The operator then attaches a first lifting member 47 (e.g., a chain) to the fastener 43*b* on the end of the telescoping horizontal arm 32*b* of the second crane member 23*b*. The first lifting member 47 is then secured around the frame of the mobile irrigation system 62 near the flat or defective tire 46, as shown in FIG. 9. The operator then uses the handheld control 42 to move the second crane member 23*b* in an upwards direction to raise the tire 46 up off the ground and out of the mud and to suspend the tire 46 in the air.

The operator then unplugs the handheld control 42 and plugs it into the appropriate outlet 57 for operating the first crane member 23*a*. The operator attaches a second lifting member 47, which can be secured to and used for lifting a tire 46, to the fastener 43*a* on the end of the telescoping horizontal arm 32*a* of the first crane member 23*a*. The operator uses the handheld control 42 to rotate and reposition the second lifting member 47 near the tire 46. The operator secures the second lifting member 47 to the defective tire 46 and unbolts the tire 46 from the gearbox 49 on the mobile irrigation system 62. If desired, the operator can use an air-powered impact wrench attached to the air hose 45 to quickly and easily unbolt the tire 46 from the gearbox 49. Once the tire 46 is unbolted, the operator pulls the tire 46 off the gearbox 49 with the tire 46 still secured to the second lifting member 47 and first crane member 23*a*. The operator then uses the handheld control 42 to move and rotate the first crane member 23*a* to maneuver the tire 46 onto the carrying area 39 of the apparatus 20.

Once the tire 46 has been placed in the carrying area 39 by the first crane member 23*a*, the operator detaches the defective tire 46 from the second lifting member 47 and attaches the second lifting member 47 to a replacement tire 46 that is stored in the carrying area 39. The operator then uses the handheld control 42 to rotate the crane member 23*a* with the attached replacement tire 46 towards the mobile irrigation system 62. The operator properly aligns the replacement tire 46 with the gearbox 49 and the operator can use the air-powered impact wrench to quickly bolt the tire 46 to the gearbox 49. Once the replacement tire 46 is attached to the mobile irrigation system 62, the operator detaches the second lifting member 47 from the tire 46 and then detaches the second lifting member 47 from the first crane member 23*a*.

Next, the operator unplugs the handheld control 42 and plugs it into the appropriate outlet 57 for operating the second crane member 23*b*. The operator uses the handheld control 42 to lower the second crane member 23*b*, as well as the attached frame of the irrigation system, until the tire 46 is placed back on the ground. Lastly, the operator removes the first lifting member 47 from the frame of the mobile irrigation system 62, removes the first lifting member 47 from the second crane member 23*b*, moves the locking arm 24*a* of the first crane member 23*a* back into the locked position, and transports the dual crane apparatus 20 out of the field.

The above described method is just one example of a method of using the disclosed dual crane apparatus for changing a tire on a mobile irrigation system. Those skilled in the art will appreciate that the disclosed apparatus can be used for servicing mobile irrigation systems in various manners and that the disclosed apparatus can be used for repairing other systems in need of service.

It is important to note that the construction and arrangement of the elements of the apparatus provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes and proportions of the various components) without materially departing from the novel teachings and advantages of the invention.

Though the disclosed dual crane apparatus is illustrated in the accompanying Figures with its application for use with mobile irrigation systems, note that it is not intended to limit the spirit and scope of the present invention solely for use in conjunction with mobile irrigation systems. Many other uses of the present invention will become obvious to one skilled in the art upon acquiring a thorough understanding of the present invention. Once given the above disclosures, many other features, modifications and variations will become apparent to the skilled artisan in view of the teachings set forth herein. Such other uses, features, modifications and variations are, therefore, considered to be a part of this invention, the scope of which is to be determined by the following claims.

The invention claimed is:

1. A dual crane apparatus, comprising:

a support frame including:

a first mounting structure configured for attachment of a first rotating crane member;

a second mounting structure connected to said first mounting structure via a base, said second mounting structure configured for attachment of a second rotating crane member; and said base forming the bottom surface of said first mounting structure and said second mounting structure; said first and second rotating crane members are able to rotate relative each other;

said first rotating crane member mounted to said first mounting structure, wherein said first crane member comprises:

a first vertical arm having a first end and a second end, a first telescoping horizontal arm having a first end and a second end, said first end being articulately coupled to said second end of said first vertical arm, and a first actuating arm having a first end and a second end, said second end being attached to said first telescoping horizontal arm, wherein said first actuating arm is arranged and configured to move said second end of said first telescoping horizontal arm up and down; and said second rotating crane member mounted to said second mounting structure, wherein said second crane member comprises:

a second vertical arm having a first end and a second end, a second telescoping horizontal arm having a first end and a second end, said first end being articulately coupled to said second end of said second vertical arm, and a second actuating arm having a first end and a second end, said second end being attached to said second telescoping horizontal arm, wherein said second actuating arm is arranged and configured to move said second end of said second telescoping horizontal arm up and down; and one or more legs attached to said base, wherein said one or more legs hold up said base and said support frame above a ground surface.

2. The apparatus according to claim 1, wherein said first mounting structure and said second mounting structure are covered by side panels and at least one of said side panels is attached to said support frame using hinged attachment members.

3. The apparatus according to claim 1, wherein said first mounting structure further includes at least one toolbox mounted inside said first mounting structure.

4. The apparatus according to claim 1, wherein said one or more legs further comprise one or more feet members fastened to said one or more legs, wherein said one or more feet members are fastened to said one or more legs in a manner which allows said one or more feet members to be partially unfastened from said one or more legs to allow said feet members to swivel at least ninety degrees such that said one or more feet members are perpendicular to said one or more legs.

5. The apparatus according to claim 1, further comprising a carrying area positioned between said first mounting structure and said second mounting structure, wherein said carrying area includes three solid side surfaces, a solid bottom surface formed by said base, one open side surface, and an open top surface.

6. The apparatus according to claim 5, wherein said carrying area further includes a restraining member to restrain items from falling out said open side surface.

7. The apparatus according to claim 1, wherein said apparatus further includes one or more attachment members fixed to said support frame, said one or more attachment members being arranged and configured for releasably attaching said support frame to a mobile carrying unit.

8. The apparatus according to claim 1, further comprising:

a first rotating plate attached to said first mounting structure, wherein said first end of said first vertical arm is mounted to said first rotating plate and said first end of said first actuating arm is mounted to said first rotating plate; and a second rotating plate attached to said second mounting structure, wherein said first end of said second vertical arm is mounted to said second rotating plate and said first end of said second actuating arm is mounted to said second rotating plate.

9. The apparatus according to claim 8, further comprising:

a first fixed plate mounted to said first mounting structure, wherein said first rotating plate is attached to a top surface of said first fixed plate; and a second fixed plate mounted to said second mounting structure, wherein said second rotating plate is attached to a top surface of said second fixed plate.

10. The apparatus according to claim 9, wherein said first rotating plate and said first fixed plate define first turret plates and wherein said second rotating plate and said second fixed plate define second turret plates.

11. The apparatus according to claim 9, wherein said first rotating plate and said first fixed plate define a first thrust bearing and wherein said second rotating plate and said second fixed plate define a second thrust bearing.

12. The apparatus according to claim 1, wherein said first telescoping horizontal arm further comprises:

a first fixed member, a first telescoping member telescopically connected to said first fixed member, wherein said first telescoping member is extendable and retractable in relation to said first fixed member, and a first actuating member connected to said first telescoping member, wherein said first actuating member forces extension and retraction of said first telescoping member; and said second telescoping horizontal arm further comprises:

a second fixed member, a second telescoping member telescopically connected to said second fixed member, wherein said second telescoping member is extendable and retractable in relation to said second fixed member, and a second actuating member connected to said second telescoping member, wherein said second actuating member forces extension and retraction of said second telescoping member.

13. The apparatus according to claim 12, further including a hydraulic system for operating said first crane member and said second crane member, said hydraulic system comprising:

a main valve body;

a first hydraulic motor in fluid communication with said main valve body, said first hydraulic motor being arranged and configured for causing rotation of said first crane member;

a second hydraulic motor in fluid communication with said main valve body, said second hydraulic motor being arranged and configured for causing rotation of said second crane member;

a first hydraulic cylinder in fluid communication with said main valve body, said first hydraulic cylinder defining said first actuating arm being arranged and configured for causing vertical movement of said second end of said first telescoping horizontal arm;

a second hydraulic cylinder in fluid communication with said main valve body, said second hydraulic cylinder defining said first actuating member being arranged and configured for causing extension and retraction of said first telescoping member;

a third hydraulic cylinder in fluid communication with said main valve body, said third hydraulic cylinder defining said second actuating arm being arranged and configured for causing vertical movement of said second end of said second telescoping horizontal arm; and a fourth hydraulic cylinder in fluid communication with said main valve body, said fourth hydraulic cylinder defining said second actuating member being arranged and configured for causing extension and retraction of said second telescoping member.

14. The apparatus according to claim 13, further comprising a handheld control for actuating said main valve body.

15. The apparatus according to claim 14, wherein said handheld control further comprises:

a first switch for communicating with said main valve body by sending signals from said first switch to said main valve body, wherein actuation of said first switch causes vertical movement of said second end of said telescoping horizontal arm;

a second switch for communicating with said main valve body by sending signals from said second switch to said main valve body, wherein actuation of said second switch causes horizontal movement of said telescoping member of said telescoping horizontal arm; and a third switch for communicating with said main valve body by sending signals from said third switch to said main valve body, wherein actuation of said third switch causes rotation of said crane member.

16. The apparatus according to claim 1, wherein said second end of said first telescoping horizontal arm further includes a first fastener attached thereto, said first fastener being configured for attachment of a first lifting member for lifting items by said first crane member; and said second end of said second telescoping horizontal arm further includes a second fastener attached thereto, said second fastener being configured for attachment of a second lifting member for lifting items by said second crane member.

17. The apparatus according to claim 1, further comprising:

a first locking arm having a first end and a second end, said first end being attached to a first attachment point affixed to said first mounting structure, and said second end being releasably attachable to a second attachment point affixed to said first crane member, wherein said first locking arm is configured to prevent rotation of said first crane member when said first locking arm is attached to said second attachment point; and a second locking arm having a first end and a second end, said first end being attached to a third attachment point affixed to said second mounting structure, and said second end being releasably attachable to a fourth attachment point affixed to said second crane member, wherein said second locking arm is configured to prevent rotation of said second crane member when said second locking arm is attached to said fourth attachment point.

18. The apparatus according to claim 1, further comprising:

an air compressor system attached to said support frame, wherein said air compressor system includes:

an air compressor unit connected to a driving motor, an air tank connected to said air compressor unit, and an air hose connected to said air tank, wherein said air hose is configured for attachment of air powered devices.

19. The apparatus according to claim 1, further comprising:

a first limit switch for limiting the degree of clockwise rotation of said first crane member;

a second limit switch for limiting the degree of counter-clockwise rotation of said first crane member;

a third limit switch for limiting the degree of clockwise rotation of said second crane member; and a fourth limit switch for limiting the degree of counter-clockwise rotation of said second crane member.

20. The apparatus according to claim 1, wherein said first vertical arm comprises a first rotating shaft and said second vertical arm comprises a second rotating shaft.

21. The apparatus according to claim 20, further comprising:

a first bearing member, wherein said first bearing member is attached to said second end of said first rotating vertical arm;

a second bearing member, wherein said first rotating vertical arm extends through said second bearing member;

a third bearing member, wherein said first rotating vertical arm extends through said third bearing member;

a first drive motor connected to said first end of said first rotating vertical arm, wherein said first drive motor produces a rotational force causing rotation of said first vertical arm; and a fourth bearing member, wherein said fourth bearing member is attached to said second end of said second rotating vertical arm;

a fifth bearing member, wherein said second rotating vertical arm extends through said fifth bearing member;

a sixth bearing member, wherein said second rotating vertical arm extends through said sixth bearing member; and a second drive motor connected to said first end of said second rotating vertical arm, wherein said second drive motor produces a rotational force causing rotation of said second vertical arm.

22. The apparatus according to claim 20, further comprising:

first bracing arms, wherein said first bracing arms are attached to said support frame and are connected to said first rotating vertical arm for supporting said first crane member; and second bracing arms, wherein said second bracing arms are attached to said support frame and are connected to said second rotating vertical arm for supporting said second crane member.

23. The apparatus according to claim 20, wherein said first end of said first actuating arm is attached to a first attachment member affixed to said first rotating vertical arm;

said second end of said first actuating arm is attached to a second attachment member affixed to said first telescoping horizontal arm;

said first end of said second actuating arm is attached to a third attachment member affixed to said second rotating vertical arm; and said second end of said second actuating arm is attached to a fourth attachment member affixed to said second telescoping horizontal arm.

24. The apparatus according to claim 7, wherein said apparatus is used for a method of changing a flat tire on a mobile irrigation system, said method comprising the following steps:

attaching said one or more attachment members to said mobile carrying unit;

lifting said apparatus off the ground surface using said mobile carrying unit;

transporting said apparatus to said mobile irrigation system;

positioning said apparatus near said flat tire;

using said mobile carrying unit to lower said apparatus towards the ground surface until said one or more legs touch the ground surface;

attaching a first lifting member to the second end of the first telescoping horizontal arm;

securing said first lifting member around a frame of the mobile irrigation system near the flat tire;

moving said first telescoping horizontal arm in an upwards direction to raise the tire off the ground surface;

attaching a second lifting member to the second end of said second telescoping horizontal arm;

rotating the second crane member so that the attached second lifting member is positioned near the flat tire;

attaching the second lifting member to the flat tire;

unbolting and removing the flat tire from the mobile irrigation system;

using the second crane member to maneuver the attached flat tire onto a carrying area of the apparatus;

detaching the flat tire from the second lifting member;

attaching a replacement tire to the second lifting member;

using the second crane member to maneuver the attached replacement tire towards the mobile irrigation device;

positioning the replacement tire for attachment to the mobile irrigation system;

bolting the replacement tire to the mobile irrigation system;

detaching the second lifting member from the replacement tire;

moving said first crane member in a downwards direction to lower the attached mobile irrigation system to the ground surface; and detaching the first lifting member from the frame of the mobile irrigation system.

25. The apparatus according to claim 1, wherein said one or more legs stand upon the ground surface and remain detached from the ground surface.

26. The apparatus according to claim 1, wherein said first mounting structure houses a first drive motor for operating said first crane member and said second mounting structure houses a second drive motor for operating said second crane member.

27. A dual crane apparatus, comprising:

a support frame including:

a first mounting structure;

a second mounting structure connected to said first mounting structure via a base; and a carrying area positioned between said first mounting structure and said second mounting structure;

wherein said first mounting structure, said second mounting structure, and said carrying area share said base, said base forming the bottom surface of said support frame;

one or more legs attached to said base, wherein said one or more legs support said base above a ground surface;

a first rotating crane member mounted to said first mounting structure, wherein said first crane member comprises:

a first vertical arm having a first end and a second end, a first telescoping horizontal arm having a first end and a second end, said first end being articulately coupled to said second end of said first vertical arm, and a first actuating arm having a first end and a second end, said second end being attached to said first telescoping horizontal arm, wherein said first actuating arm is arranged and configured to move said second end of said first telescoping horizontal arm up and down; and a second rotating crane member mounted to said second mounting structure, wherein said second crane member comprises:

a second vertical arm having a first end and a second end, a second telescoping horizontal arm having a first end and a second end, said first end being articulately coupled to said second end of said second vertical arm, and a second actuating arm having a first end and a second end, said second end being attached to said second telescoping horizontal arm, wherein said second actuating arm is arranged and configured to move said second end of said second telescoping horizontal arm up and down; said first and second rotating crane members are able to rotate relative each other.

28. The apparatus according to claim 27, wherein said one or more legs further comprise one or more feet members fastened to said one or more legs, wherein said one or more feet members are fastened to said one or more legs in a manner which allows said one or more feet members to be partially unfastened from said one or more legs to allow said feet members to swivel at least ninety degrees such that said one or more feet members are perpendicular to said one or more legs.

29. The apparatus according to claim 27, wherein said carrying area is arranged and configured to carry a tire of a mobile irrigation system.

30. A dual crane apparatus, comprising:

a portable support frame including a first mounting structure and a second mounting structure;

a base connecting said first mounting structure to said second mounting structure, said base forming the bottom surface of said support frame, said base forming the bottom surface of said first mounting structure, and said base forming the bottom surface of said second mounting structure;

one or more legs attached to said base, wherein said one or more legs hold up said support frame and said base above a ground surface;

a first rotating crane member mounted to said first mounting structure, wherein said first crane member comprises:

a first vertical arm having a first end and a second end, a first telescoping horizontal arm having a first end and a second end, said first end being articulately coupled to said second end of said first vertical arm, and a first actuating arm having a first end and a second end, said second end being attached to said first telescoping horizontal arm, wherein said first actuating arm is arranged and configured to move said second end of said first telescoping horizontal arm up and down; and a second rotating crane member mounted to said second mounting structure, wherein said second crane member comprises:

a second vertical arm having a first end and a second end, a second telescoping horizontal arm having a first end and a second end, said first end being articulately coupled to said second end of said second vertical arm, and a second actuating arm having a first end and a second end, said second end being attached to said second telescoping horizontal arm, wherein said second actuating arm is arranged and configured to move said second end of said second telescoping horizontal arm up and down; said first and second rotating crane members are able to rotate relative each other.

31. The apparatus according to claim 30, wherein said one or more legs further comprise one or more feet members fastened to said one or more legs, wherein said one or more feet members are fastened to said one or more legs in a manner which allows said one or more feet members to be partially unfastened from said one or more legs to allow said feet members to swivel at least ninety degrees such that said one or more feet members are perpendicular to said one or more legs.

* * * * *